US008602416B2

(12) United States Patent
Toyama

(10) Patent No.: US 8,602,416 B2
(45) Date of Patent: Dec. 10, 2013

(54) CARD SHUFFLING DEVICE AND METHOD

(75) Inventor: Hirohide Toyama, Darien, IL (US)

(73) Assignee: Shuffle Tech International LLC, Chicago, IL (US)

( * ) Notice: Subject to any disclaimer, the term of this patent is extended or adjusted under 35 U.S.C. 154(b) by 135 days.

(21) Appl. No.: 12/976,181

(22) Filed: Dec. 22, 2010

(65) Prior Publication Data

US 2011/0233863 A1 Sep. 29, 2011

Related U.S. Application Data

(63) Continuation-in-part of application No. 12/828,954, filed on Jul. 1, 2010, now Pat. No. 8,109,514, which is a continuation of application No. 12/121,484, filed on May 15, 2008, now Pat. No. 7,854,430.

(60) Provisional application No. 60/931,646, filed on May 24, 2007, provisional application No. 61/289,830, filed on Dec. 23, 2009.

(51) Int. Cl.
*A63F 1/12* (2006.01)

(52) U.S. Cl.
USPC ..... 273/149 R

(58) Field of Classification Search
USPC ..... 273/149 R, 149 P
See application file for complete search history.

(56) References Cited

U.S. PATENT DOCUMENTS

| | | | | | |
|---|---|---|---|---|---|
| 1,014,219 | A | * | 1/1912 | Hall | 273/149 R |
| 1,998,690 | A | * | 4/1935 | Shepherd et al. | 273/149 R |
| 2,060,096 | A | * | 11/1936 | McCoy | 273/149 R |
| 2,747,877 | A | * | 5/1956 | Howard | 273/149 R |
| 5,096,197 | A | * | 3/1992 | Embury | 273/149 R |
| 5,584,483 | A | * | 12/1996 | Sines et al. | 273/149 R |

* cited by examiner

*Primary Examiner* — Benjamin Layno
(74) *Attorney, Agent, or Firm* — Brinks Gilson and Lione

(57) ABSTRACT

A card shuffling device is described where the device is configured to be mountable below a table top and accessible by an aperture formed in the table top. Cards are inserted into an aperture on the top of the card shuffling device with the face of the cards being in a horizontal plane. The cards are transported to a shuffling compartment where the cards are shuffled by ejection of the cards in a vertical direction. The shuffled cards are returned to the region of the aperture by an elevator mechanism for dispensing. A card counting device may also be included, where the counting is performed by ejecting the cards from a deck of cards in a vertical direction such that the cards pass individually through a sensing region.

5 Claims, 23 Drawing Sheets

Side cross-section

CARD SHUFFLING DEVICE AND METHOD

This application is a continuation-in-part of U.S. Ser. No. 12/828,954, filed on Jul. 1, 2010, now U.S. Pat. No. 8,109,514 which is a continuation application of U.S. Ser. No. 12/121,484, filed on May 15, 2008, now U.S. Pat. No. 7,854,430 which claims the benefit of U.S. provisional application 60/931,646, filed on May 24, 2007, each of which is incorporated herein by reference. This application also claims the benefit of U.S. provisional application 61/289,830, filed on Dec. 23, 2009, which is incorporated herein by reference.

TECHNICAL FIELD

This application relates to an apparatus and method for preparing playing cards for use in a game of cards.

BACKGROUND

Various games are played using playing cards, where a typical game uses one or more decks, which may have 52 cards of various values and suits. Examples of such games that are popular in the United States are poker, blackjack, bridge, and canasta. In other countries, different games of cards are similarly popular, and may use decks of cards having more or less than 52 cards, and having different markings. Players of games of cards have an interest in ensuring that the playing cards are dispensed for the game in a random manner, giving no one player an unfair advantage. Preparing a deck of cards for play of the game may be accomplished either manually or automatically. In the case of manual preparation, the cards may be cut, riffled and stripped. The process is performed multiple times. It is believed that performing a cut-riffle process approximately 7 times will result in a sufficiently random distribution of cards within a deck. However this is time consuming and it is common to perform the process only 3-4 times.

The most popular styles of playing cards, those intended for bridge or poker are of two relatively standardized shapes in planar view. The most common sizes for playing cards are poker size (2½ in×3½ in; 63 mm×88 mm, or B8 size according to ISO 216) and bridge size (2¼ in×3½ in, approx. 56 mm×88 mm). Other sizes are also available. The cards are typically fabricated of a paper or a plastic, or a combination thereof, and variety of surface textures, card weight and flexing properties are considered acceptable by players, and differ by manufacturer and style of card.

SUMMARY

A apparatus and method for shuffling cards, where the apparatus may be mounted beneath a table-like surface is described, the device having a housing with a top surface adapted to be mountable to the mounting surface; an aperture in the top surface dimensioned so that a deck of cards, oriented with a card face horizontally disposed is insertable into the aperture; a first transport mechanism adapted to move the deck of cards in a horizontal direction so as to fall into a compartment; a card shuffling device adapted to shuffle cards in the compartment; a second transport mechanism adapted to move the deck of cards in a vertical direction to an upper position in the compartment; a lift-gate mechanism adapted to transfer the deck of cards from the upper position in the compartment to a position on the first transport mechanism.

A device and method of counting cards of a deck of cards is described. The device is intended to be a part of a shuffling device and has a compartment sized and dimensioned to receive a plurality of cards, each card of the plurality of cards having a height dimension and a width dimension parallel to a face thereof, a thickness dimension orthogonal to the face thereof; and, edges around the periphery of the face; the received cards having a rest position with an edge of a card of the deck of cards in contact with a lower surface of the compartment. A first; and operates so as to eject cards of the plurality of cards in an upwards direction and a second forcer operable to urge the cards of the deck of cards against the first forcer. A retractable carrier is positioned above the first forcer and has a roller protruding through a vertical surface thereof. A third forcer is positioned above the first forcer and cooperates with a roller on the retractable carrier to urge a card of the deck of cards in the upwards direction so as to be ejected above the retractable carrier.

When cards are to be counted, the retractable carrier is positioned so that the vertical surface thereof is parallel to a first wall of the compartment and spaced apart therefrom by a distance equal approximately to the thickness dimension of the card so as to form a slot. The passage of a card through the slot is sensed by a sensor assembly.

DETAILED DESCRIPTION

Exemplary embodiments may be better understood with reference to the drawings, but these embodiments are not intended to be of a limiting nature. Like numbered elements in the same or different drawings perform equivalent functions.

When a specific feature, structure, or characteristic is described in connection with an example, it will be understood that one skilled in the art may effect such feature, structure, or characteristic in connection with other examples, whether or not explicitly stated herein. Embodiments of this invention may be implemented in hardware, firmware, software, or any combination thereof, and may include instructions stored on a machine-readable medium.

It will be understood that the recitation of elements and functionalities of the embodiments is intended to convey an appreciation for the types of elements and functionalities which may be present, however not all of the elements and functionalities may be found in a specific embodiment, and the elements or functionalities may be used multiple times in a device made in accordance with these teachings.

The act of randomizing a deck of cards prior to use in a game of cards is intended to make the order of the cards in the deck of cards unknown to a person playing the game of cards, even with the state of the deck of cards being known prior to the randomization. This is considered to place all of the players of the game in a state of equal knowledge of the situation which obtains at any stage of the play of the game. In common parlance, this process is called "shuffling the deck," and may include the steps of cutting, striping and riffling as described, for example, in U.S. patent application Ser. No. 11/706,707, filed on Feb. 15, 2007, which is incorporated herein by reference.

Herein, however, the term "shuffling" the deck is used to describe an apparatus and method which distributes the cards of a deck of cards so as to achieve an effectively random distribution of the order of the cards. The details of the operation of the shuffling device and method may not correspond to the traditional steps of cutting, stripping or riffling; however, the result may be that the deck of cards has been placed in an effectively random order state. An "effectively random" ordered deck of cards would be understood by a person of skill in the art to, for example, defeat a strategy of card counting as a betting strategy in a card game. Such a shuffle would be accepted by players of the game as to be fair to all of the participants, so that the game may be played according to an accepted strategy where each card distributed to a player is not known a priori. Of course, in games of cards where the cards are exposed during the play of the game, a player may use knowledge of the exposed cards, and cards held by the player, to deduce the remaining cards in the deck, but not the explicit order of the cards as dispensed.

Figure 1:
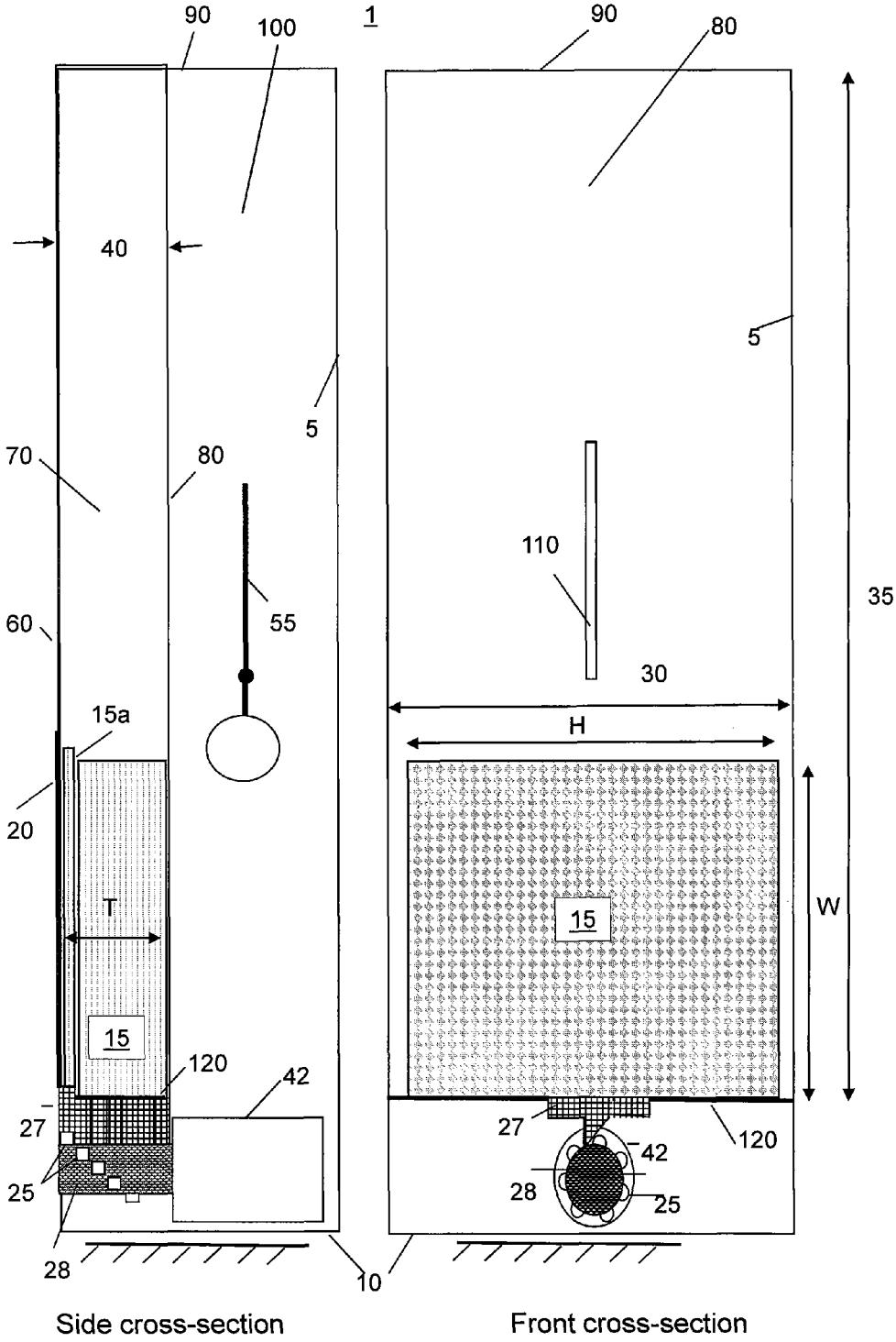
FIG. 1 shows front and side views of cross sections of the shuffling device, positioned vertically.

A card shuffling device 1 is shown in side and front cross section views in FIG. 1. The device 1 illustrated may be intended for, and dimensioned for use with, a single deck of cards, two decks of cards, or less than a deck of cards. It will be appreciated that a device capable of shuffling multiple decks of cards may also be capable of shuffling a single deck of cards or less than a standard deck of cards. The subsequent discussion will be in terms of a single deck of cards for clarity, however unless otherwise excluded, the operations are equally possible for a stack of cards comprising more or less than one standard deck.

Playing cards may be rectangular sheets of material, having a durable surface and the values and suits of a deck suitable for playing a game of cards displayed thereon. Often, the playing cards have a plastic surface, or are made wholly of plastic, although paper playing cards are known. Although the deck of cards may have more or less than 52 cards, for convenience in discussion a deck of cards is considered to be comprised of 52 cards. The dimensions of a single playing card may vary depending on the game of cards for which the deck is intended. For example, bridge and poker cards typically have different linear dimensions; however, a particular deck of cards may be used to play a game of cards for which the dimensions are not optimal.

For the purpose of discussion, the dimensions of the face are termed are the height H and the width W, respectively, so as to encompass decks of cards having other than the nominal dimensions. Each card of the deck of cards has a thickness, and the plurality of cards making up a deck of cards has a thickness T, the thickness being a dimension orthogonal to the height H and the width W of the cards. The periphery of the face is comprised of four edges, and the corners of the faces, where the edges meet, may be rounded.

The shuffling device may have a rectangular-parallelepiped-shaped interior compartment 70 having a first dimension 30 slightly greater than the card height H, a second dimension 35 at least twice the width W of the card, and a third dimension 40 greater than the thickness T of a deck of cards 15. The first dimension may be approximately 4 inches; and, the second dimension is not less than approximately 5 inches. In an alternative, the deck of cards 15 may be rotated by 90°.

A deck of cards may introduced into the interior of the device 1, for example through a lid 20 (shown closed), and the device 1 may be stood on an end 10 or base thereof. The second dimension of the interior compartment 70 may be oriented in a vertical position so that edges of the cards of the deck of cards 15 are parallel to a gravity vector g. The cards in the deck are acted on by a forcer so as to eject a contiguous group of cards 15*a* from the deck of cards 15 so as to be introduced into a space above the remainder of the deck of cards 15 in the second dimension. For this purpose, the thickness of the deck T may be considered to be divided into a plurality of volumes 15*a*, each volume 15*a* including a portion of the deck 15. The volumes 15*a* may not each contain the same number of cards. When the deck is in a static position of repose, and the device 1 is oriented as shown in FIG. 1, the cards are urged against a bottom surface 120 of the interior compartment 70 by the force of gravity.

A forcer or launching device, for example, a piston 27 and a kicker 25, which may be a cam, a piston, an electrical solenoid, a pneumatic cylinder, or the like, acts on a card volume 15*a*, at the lower surface thereof, so as to eject the card volume 15*a* upwards. Card volumes 15*a* may be ejected upwards in a sequential manner, until substantially all of the cards in a deck of cards have been so ejected. The volumes sequentially ejected may be arranged a physically contiguous sequence, or may be ejected in another order. The ejection sequence may repeated rapidly for a plurality of such sequences. It may be imagined that the cards are in a somewhat chaotic state, with some cards being in contact with the bottom surface 120 or the piston 27, and some cards in varying dynamic positions, displaced with respect to the bottom surface, depending approximately on the time since the last ejection of the particular card or groups of cards. The pistons 27 may project above a surface 120 when actuated, which may be the surface that the cards rest upon when the device is not ejecting cards.

The ejection of a volume of cards 15*a* may be characterized as having a number of states: for example, repose, ejection, upward free flight, and free fall. In repose, the cards of the volume may be at rest with respect to the bottom surface 120, and in contact with either the bottom surface 120, or a piston 27 projecting through the bottom surface, or both of the structures. When the piston 27 is actuated, so as to eject the volume of cards 15*a*, the piston 27 moves rapidly in the second dimension of the interior compartment 70, and the volume of cards 15*a* being in contact with the piston 27 is accelerated in the second dimension until the piston 27 reaches the end of a travel distance. The piston 27 is constrained so the overall linear motion is limited, however, the volume of cards 15*a* may continue to move in the second dimension, with an initial velocity equal to the terminal velocity of the piston 27. The motion of the piston 27 is arrested by a stop or other mechanism, and the piston 27 may return to the repose position by action of the force of gravity. The return may be assisted by a spring, a double acting solenoid or pneumatic device, or other mechanism having a similar effect. The volume of cards 15*a*, however, continues in an upward direction, and may be said to be ejected from the remainder of the deck 15. The initial velocity of the volume of cards 15*a* when the piston 15*a* reaches the end of the stroke is sufficient that the minimum height reached by a lower card edge of the volume of cards 15*a* is greater than the dimension of a card in the direction of motion.

As the volume of ejected cards move in upward in free flight, the cards experience deceleration due to the force of gravity, and the velocity decreases such that, after a period of time, the vertical velocity of the cards is zero, at the maximum height of the cards above the surface 120. The cards then begin free fall, accelerated by the force of gravity, such that the motion of the cards is towards the repose surface 120, and the velocity of the cards increases with time, until the cards return to contact with the surface 120. The cards of the volume of cards 15*a* that was ejected now remains in repose and contact with the surface 120 until again ejected.

Due to the cross sectional dimensions of the base of the interior compartment 70 of the device 1, the individual cards have a limited ability to rotate about an axis perpendicular to the face thereof. The cards may rotate slightly so that the edges or portions of the face contacts a wall, and the motion of the card is affected by such interactions, by face-to-face contact with cards of the ejected volume, and with cards of previously or subsequently ejected volumes. Hence, while the cards may translate in the thickness direction, the cards are constrained to land on the bottom surface 120 or the piston 30 in the same rotational orientation as with which they were ejected. But, individual cards may be interchanged, or groups of cards urged to move in the thickness direction T. Movement in the thickness direction T may also occur for cards in the repose state, when acted on by other cards being ejected.

The value of the second dimension should be sufficient for the bottom edge of the ejected card to rise above the top edge of a card in repose. The value may permit the ejected card to reach an apogee of the trajectory without contacting the far end surface 90 of the interior compartment 70, or the value may result in some or all of the cards contacting the far end surface 90 during the ejection sequence.

In the example, providing that the second dimension 30 is less than the diagonal dimension of the face of a card of the deck of cards 15, the card may not be capable of rotating so as to change the rest or repose orientation of the height dimension H of the card with respect to the bottom surface. That is, the height and width dimensions of a card are not interchanged during the shuffling process, even if the card undergoes some rotational motion during the ejection process.

Where the deck of cards 15 is disposed in the alternative configuration, where the rest position of the deck of cards 15 has been rotated by 90°, an additional constraint on the second dimension 30 may be that the center of gravity of the card may need to be disposed such that it lies above the projection of the narrow dimension of the face of the card onto the bottom surface 120, in order to prevent rotation of the cards between the start and end of the process.

Figure 3:
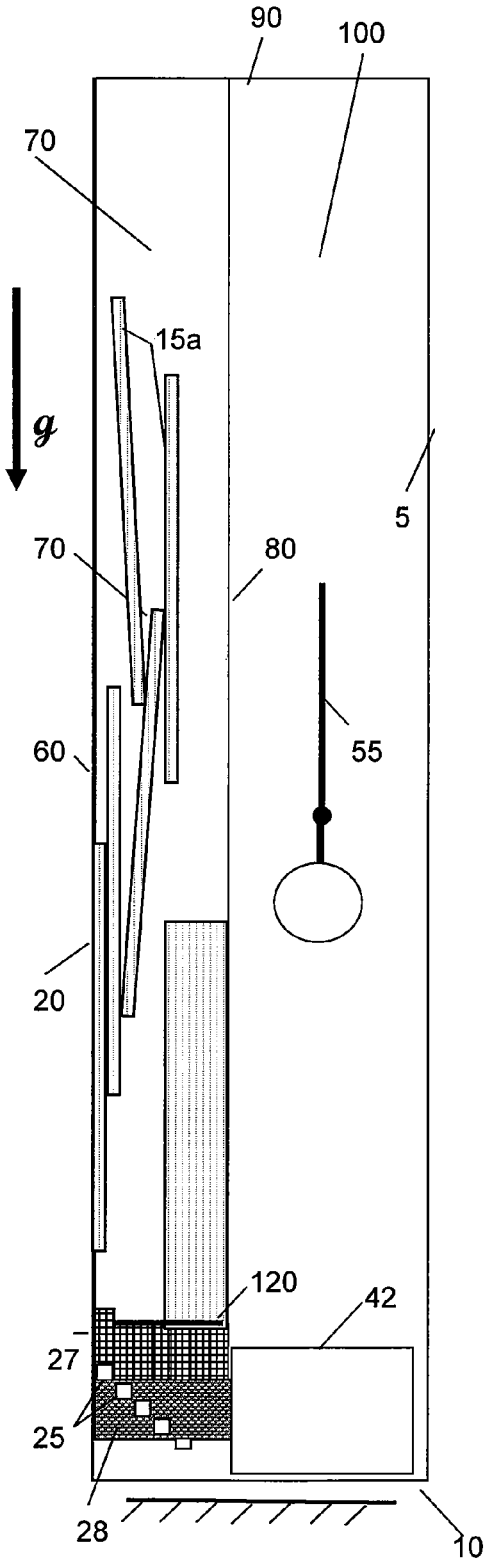
FIG. 3 is a side cross sectional view of the device of FIG. 1, positioned vertically, and with the cards being shuffled.

As may be seen in FIG. 3, when the sequence of ejections is being performed, various volumes 15*a* making up the deck of cards 15 may be in differing states with respect to the bottom surface 120.

The inventor has experimentally demonstrated this aspect of the operation of a shuffling device by using a cigarette carton as the rectangular parallelepiped compartment and a can of compressed air having a straw-type extension, such as is used to blow air into an electronics assembly for cleaning purposes. The end of the straw emitting the compressed air was directed at the base end of the carton through an aperture so that the pressurized air stream impinged on the bottom edge of cards and the nozzle rapidly moved back and forth in the thickness direction of the deck. The cards were observed to be ejected upwards in groups or individually and to reorder themselves in the somewhat chaotic environment where the cards are in various stages of flight. As the air pressure was either diminished or removed, the cards settled back into a deck of cards, resting on the base.

In the experiments, cards were placed in a deck so that the cards were ordered by suit and value, and the result of the operation above described was that the ordering of the cards in the deck of cards was observed to be effectively random after completion of the shuffling operation. A typical duration of the shuffling process was about 15 seconds.

In this manner, the ordering of cards in a deck of cards may be arranged in an effectively random manner. At the conclusion of the "shuffling" process, when the forcer sequence is terminated, the cards will be in the form of a randomized deck of cards. The shuffling device may then be rotated such that the second dimension is horizontal. This places the cards in the shuffled deck on top of each other, so that the lid or door of the shuffler can be opened, or a tray slid out and the cards removed.

The device 1, may further comprise a motor 42 turning a shaft 28, connecting to a cylinder 45, which may be termed a kicker, having projections 25 disposed at intervals along a length thereof, the projections 25 being disposed so that each of the projections 25 may come in contact with a piston 27 during a rotation of the cylinder 45. The projections 25 may have the shape of cams, or an equivalent projection may be present on a facing portion of the piston 27. The distribution of projections 25 may be such that adjacent pistons are actuated, or such that pistons 27 are actuated in some other sequence. Although the pistons 27 are shown as being contiguous across the thickness T of the deck of cards 15, the pistons 27 may have a spacing between them, and depend on the movement of cards in the T direction to move cards into position with respect to the pistons 27.

Figure 2:
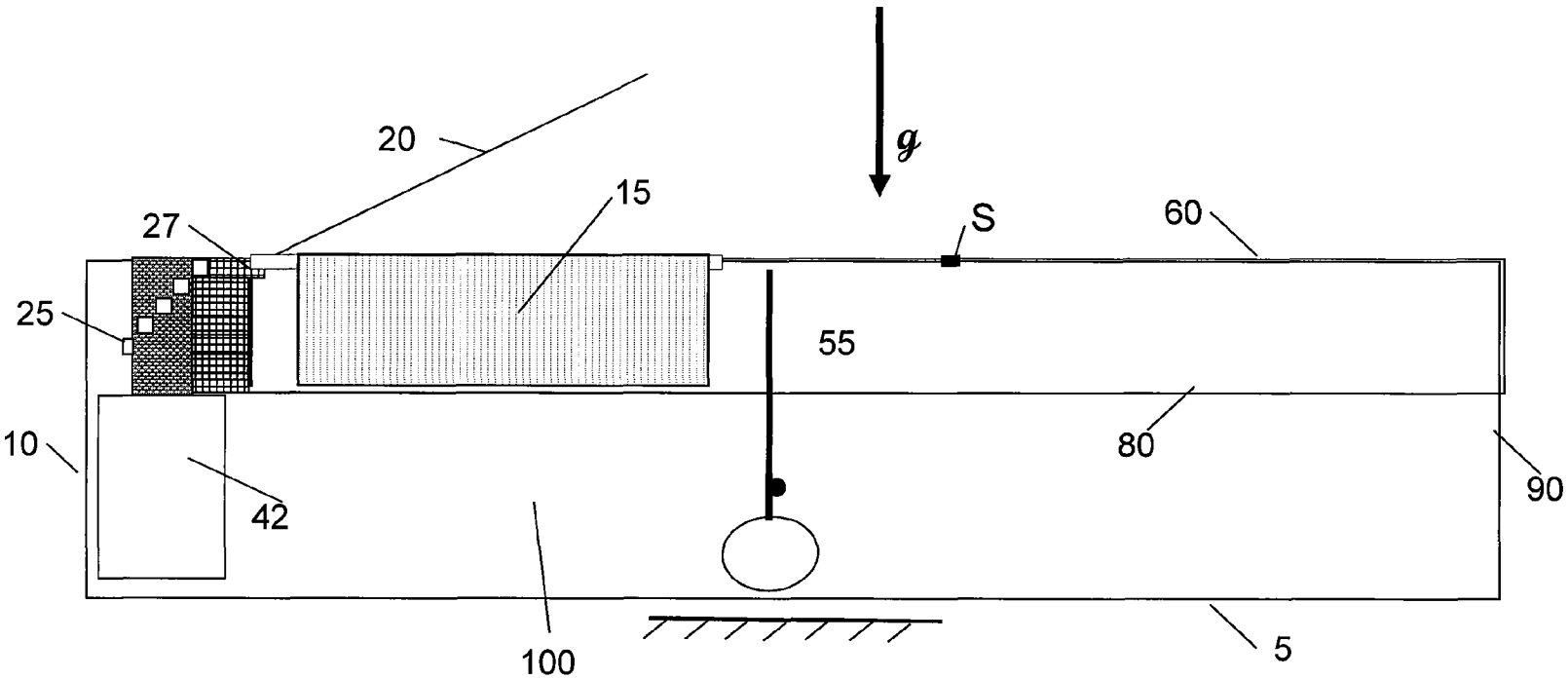
FIG. 2 is a side cross-sectional view of the device of FIG. 1, positioned horizontally, and with an access door partially opened.

FIG. 2 shows the device 1 disposed in a horizontal position, such that a surface 5 thereof is in contact with a horizontal support. Typically this support may be a table where the game of cards is being played. An interior compartment is formed by a first surface 80, extending in the second dimension, a second surface 60 also extending in the second dimension and disposed parallel to the first surface 80, separated by a distance 40, where the distance 40 is greater than the thickness T of the deck of cards 15 to be shuffled. A top end surface 90 of the device 1 is disposed opposite the base end 10, and at a distance such that a space of at least one card face dimension is provided between an inserted deck of cards 15 and the top end surface 90.

The interior surfaces 80, 60 of the compartment 70 are shown as being flat, however there may be projections (not shown) that extend towards the volume into which the cards are ejected, the projections disposed so as to convert some of the vertical motion into horizontal motion to further mix the cards. For convenience in discussion and description, the interior configuration of the compartment 70, while generally having the shape of a rectangular parallelepiped, should not, by being so described, be interpreted to exclude such mixing aids.

A compartment 100 may be provided so as to house batteries (not shown), a controller (not shown) which may be a microprocessor or other electronic or electromechanical device, and one or more motors, an air supply, or the like. The interior compartment 70 may be closed when the lid 20 is rotated or slid into a position to substantially fill an aperture through which the deck of cards 15 may be introduced into the interior compartment 70.

A compartment dividing bar 55 may rotatably project through an aperture 110 in the surface 80 so as to restrain cards of the deck 15 from inadvertently moving into the area to the right of the bar 55. The position of the bar may be changed by using a motor 50 or similar mechanism. Alternatively, as the bar is intended to be rotated with respect to the device 1 when the device 1 is moved between the vertical position of FIG. 1 and the horizontal position of FIG. 2, the motor may be replaced by an eccentric weight 50 on a shaft, and configured to maintain the bar 55 in a vertical position regardless of the operational orientation of the remainder of the device 1. Other mechanisms for positioning the divider 55 may be used.

The deck of cards 15 may be inserted into the device 1, with the device 1 in the horizontal position of FIG. 2, and the lid 20 is closed. The user rotates the device 1 to the vertical position shown in FIG. 1. In the vertical position, the deck of cards 15 slides so as to rest on the pistons 27 due to the force of gravity, and the bar 55 may have rotated to remain in a vertical position through slot 110, opening the remainder of the compartment 70 to the cards. In the front view, the compartment 70 is seen to have a first dimension 30, which is slightly greater than the height H of the cards.

The arrangement of the motor 45, the kicker 25 and the piston 27 is one of a variety of mechanical, electromechanical or pneumatic forcer mechanisms that may be used to transmit a substantially impulsive force to the edge of the cards now resting on the pistons 27. For example, the pistons may be electrically actuated by solenoids, or air pressure may be used. In an aspect, the piston may be an armature of the solenoid. A spring mechanism may be used to ensure adequate contact between a cam and the piston, as is known in a cam follower arrangement, or a spring may be provided to assist the force of gravity, when the piston is returning to a condition of repose when operated by a forcer mechanism.

FIG. 1 shows a portion 15*a* of the deck 15 lifted with respect to the remainder of the deck 15 by one of the plurality of pistons 27, indicating the motion that may be imparted to portions of the deck 15 by a piston 27 when the motor 42 is rotating, and contact between a projection 25 and a piston 27 occurs. Alternatively the piston 27 may be coupled to, for example, a solenoid. As shown in FIG. 3, when the motor 42 is actuated to rotate the shaft 45, the kickers 25 may actuate the pistons 27 in rapid succession, so as to eject portions 15*a* of the deck 15 towards the top surface 90 of the apparatus 1. The sequence of ejections may become substantially asynchronous with the motions of the groups of ejected cards, so that the cards tend to mix together and migrate to other positions in the thickness direction T of the deck 15. In this manner, the cards of the deck are effectively randomized with respect to the sequence of cards in the deck 15 which obtained when the deck 15 was initially inserted into the compartment 70. The time duration of the mixing process may be based on a timer, or the user may have the option of turning the device on and off at will. In another aspect, a pressure switch may be disposed on the base surface 10 so that the motor 42 is activated when the apparatus is in the upright position and resting on the base surface 10 as shown in FIG. 3. Other sensing means such as an accelerometer (not shown) or the rotation of bar 55 may be similarly used to determine the orientation of the device 1 with respect to the direction of the gravitational vector. The shuffling operation may proceed for a fixed period of time, or the user may terminate the shuffling with an on-off switch, or by beginning to return the apparatus to the horizontal position shown in FIG. 2.

Near the end of the shuffling process, the speed of the motor may be reduced, and the cards may begin to settle back into a substantially resting position, in contact with the surface 110. To the extent that one or more cards have not yet moved into a position that generally conforms to the full deck 15, as shown in FIG. 1, the slower motion should cause the remaining cards to slide into position. A sensor (not shown, but positioned at S) may be used to confirm that the cards are back in the form of a deck of cards 15. This sensor may be optical or mechanical, or may be omitted.

Figure 4:
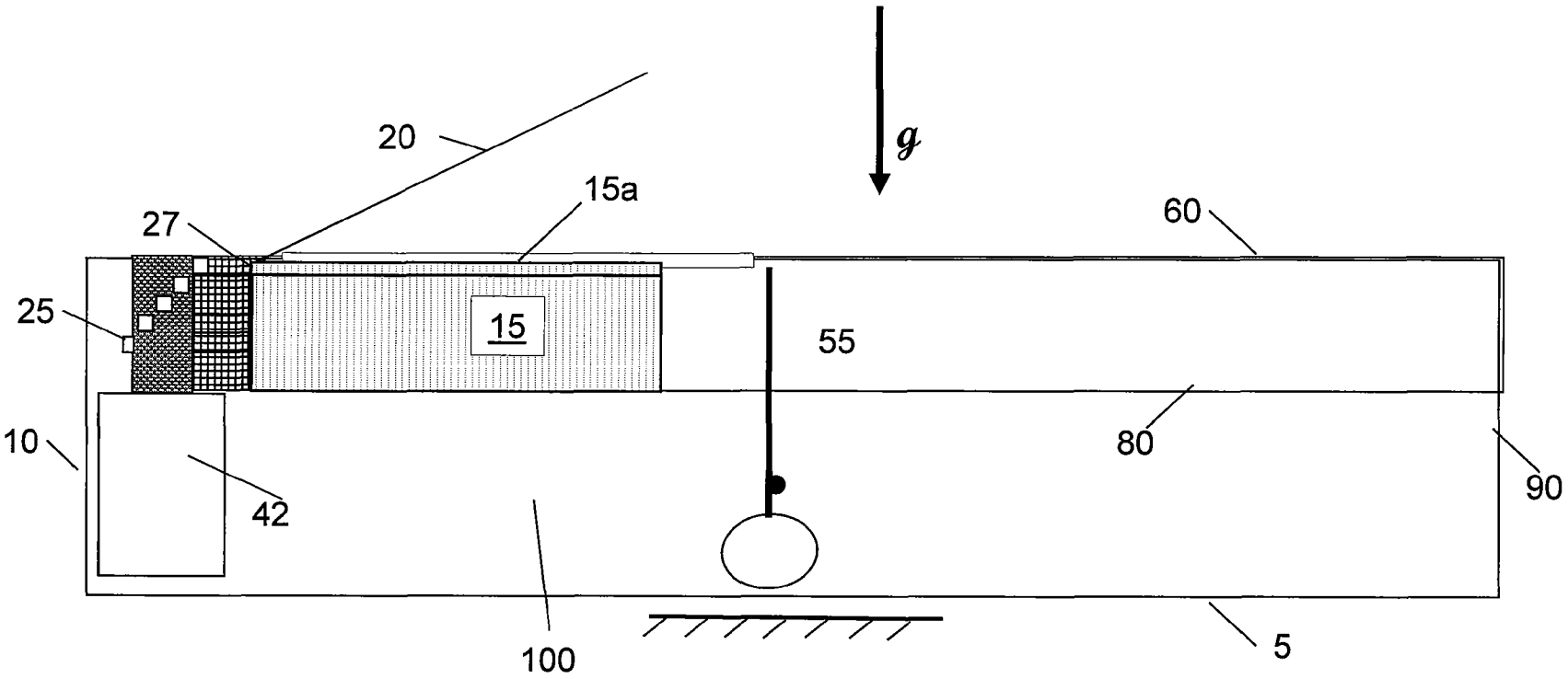
FIG. 4 shows the view of FIG. 3, with the device positioned horizontally after the completion of a shuffling operation.

FIG. 4 shows a near-end-state of the shuffling process. In this example, the bar 55 has been rotated into place by a motor 50, so as to enter the compartment 70 through the slot 110 in the surface 80, and the device 1 may still be in an orientation where the surface 5 is vertical. The device 1 may now be rotated to a horizontal position: that is, with surface 5 in a horizontal plane; and, the lid 20 may be opened to remove the deck of cards 15. Where an eccentric weight has been used in place of a motor, the bar 55 will rotate into the position shown in FIG. 4 as the surface 5 rotates into a horizontal position.

In yet another aspect, the lid 20 may be disposed that a hinge is positioned at the upper end of the aperture for insertion of the cards, and the lid 20 may extend further towards the top surface 90, so that when the lid 20 is rotated to an open position, the lid extension is rotated into the compartment 70 so as to perform the function of the bar 55.

In still another aspect, a surface of the apparatus 1 may be wholly or partially transparent, or have an aperture therein, so as to permit observation of the mixing action.

In another example, the automatic card shuffling device may be segmented at a height above the base such that the cards may be inserted or removed while the device 1 is in a vertical position (as in FIG. 1). In such a configuration, the interior compartment 70 may be formed by a lower portion and an upper portion: the lower portion being that extending from the base 10 to a location approximately that of the upper edge of a deck of cards inserted therein; that is, at or below the location of the compartment divider 55 in FIG. 1. The compartment divider itself may not be present. A relief or slot may be provided in the surface 60 so that the user may grip the cards in order to remove the cards from the lower compartment. The upper portion of the compartment may be attached to the lower portion of the compartment by a hinge, so that the upper portion of the compartment may be swung away for insertion and removal of the cards, and closed for the shuffling operation. The lid 20 and the compartment divider 55 may not be needed, since the cards may be inserted along the long dimension of the shuffler, and the device 1 may remain in a vertical position after completion of shuffling process.

In an alternative, the upper portion of the compartment 70 may be a separate structure and be joined to the lower portion of the compartment by a sliding connection so as to form a complete interior compartment 70, as in FIG. 2. The upper portion may be detached from the lower portion for the purpose of inserting or removing a deck of cards 15. The shuffling action may be initiated by a sensor determining that the compartments have been assembled, a switch, or other mechanism. The shuffling action may be dependent on the presence of cards in the compartment. The shuffling may be performed for a fixed period of time, or be controllable by the user.

Figure 5B:
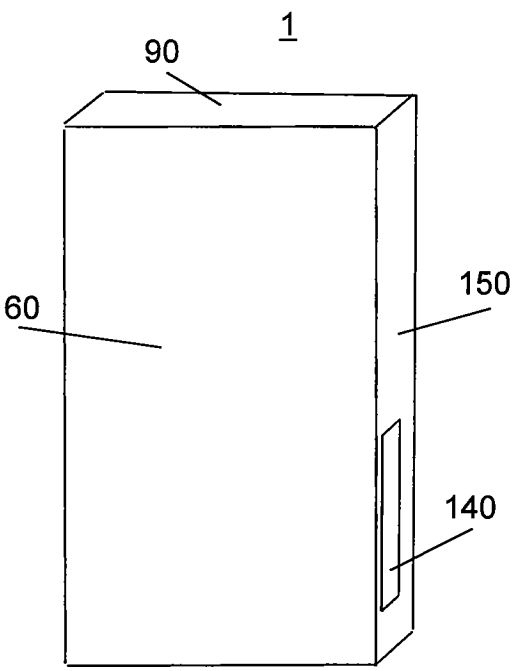
FIG. 5 is an exterior view of the device of FIG. 1, having (A) an access door, and (B) having a sliding drawer.
Figure 5A:
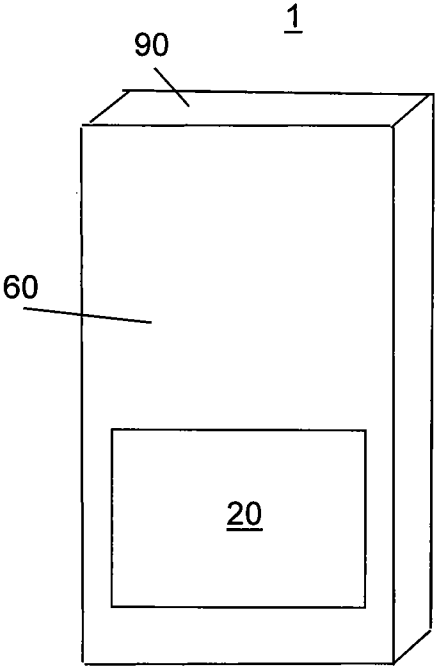

In another aspect, the device 1 of FIG. 1 may be configured so that the lid 20 is replaced by a slidable drawer 140 in a side 150 of the device 1. The lid configuration 20 and a drawer configuration are shown in exterior views in FIGS. 5A-B, respectively.

Figure 6:
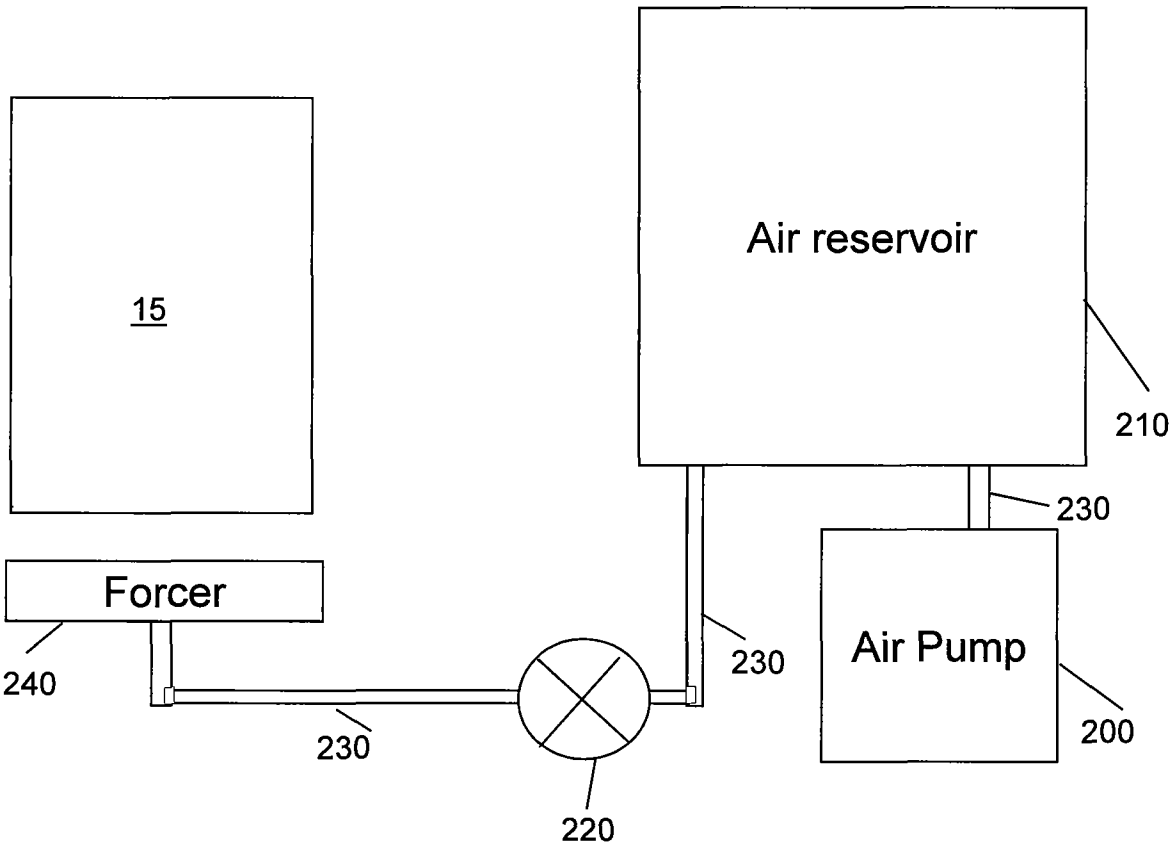
FIG. 6 is a simplified functional schematic of a pneumatic pressure source for a forcer.

In another example, shown in FIG. 6, the ejection mechanism may be pneumatic. A pneumatic pump 200 is used to charge a cylinder 210 to a pressure P, the pressure being above that of the ambient environment. The cylinder 210, may be a simple volume, or may have a piston and spring arrangement so that the filling of the cylinder involves the air pump 200 acting to fill a variable volume against the resistance of the spring. In this manner, the volume of the pressurized region increases at approximately a constant pressure. Similarly, the pressure is maintained substantially constant as the air in the cylinder 210 is discharged from the cylinder 210 so as to eject the cards 15*a* of the deck of cards. Near the end of the cycle, the piston in the cylinder 210 may reach an end of travel, so that the pressure decreases, having a similar effect as the slowing of the motor in the first example.

The cylinder 210 may be charged by the pump 200 for a fixed period of time, and then a valve 220 opened so that the air at nominal pressure P may flow from the air reservoir 210 to the forcer mechanism 240 to eject the cards. The air pump 200 may be shut off at this time, or continue to operate for some or all of the shuffling operation. After completion of the shuffling operation, the air pump 200 may be operated to charge the air reservoir 210 so as to be ready to perform another shuffling operation. Alternatively, the air pump 200 may charge the air reservoir 210 at the beginning of a shuffling operation.

In an aspect, the air pump 200 may supply air to the air reservoir 210 until a desired pressure is reached. This state may be sensed by a pressure sensor or a pressure actuated switch, and a valve 220 actuated to supply air to the forcer 240 so as to shuffle the cards. Alternatively, the air may be supplied through tube 220 so as to actuate one or more pistons 27.

Figure 7:
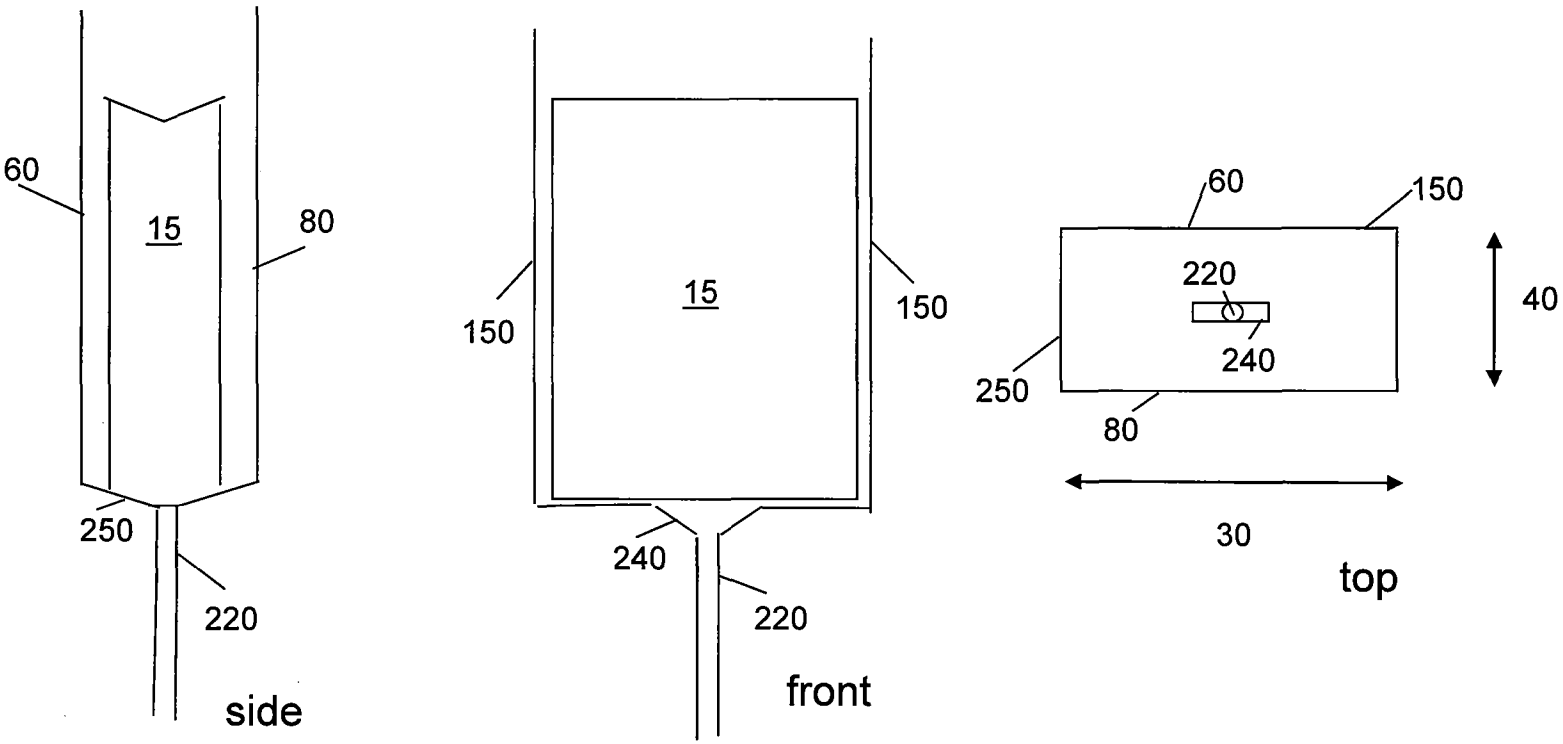
FIG. 7 shows partial cross section views of a pneumatic forcer.

FIGS. 7A-C show side, front and top views, respectively, of a forcer using pneumatic actuation. The deck of is positioned as in the example of FIG. 1, however the bottom surface 250 of the compartment 70 is slightly sloped toward the center of the deck 15 in the deck thickness direction, rather than being a flat bottom 120 as in FIG. 1. The central portion of the deck of cards 15, shown in FIG. 7B is positioned above an orifice 240 having a larger linear dimension in the direction 30, than in the direction 40, so as to apply the air pressure P delivered through the tube 220 to side edges of a group of cards of the deck of cards. The dimensions of the aperture 240 are sized such that the force applied to the edges of the group of cards is sufficient to eject the group of cards into the void above to the top of the deck of cards. The air flow may be intermittently interrupted or pulsed, and the remainder of the cards in the deck of cards 15 may tend to move towards the center-of-the-deck region, so as to be positioned above the aperture 240 to be ejected by the next air pulse. The pulsing may be controlled by an actuated valve, a rotary valve or other method of interrupting the flow of the air.

In another aspect, the bottom surface 250 may be flat such as the surface 120 in FIG. 1, and a plurality of apertures 240 spaced apart in the deck thickness direction 40 so as to applied the ejection force at different times to groups of cards at different distances from the center of the compartment 70 in the thickness direction T of the deck of cards. A slight slope in the bottom surface 250 may be provided between the apertures 240 of the plurality of apertures, so as to encourage the migration of cards in the thickness direction.

Other methods of lifting the cards may also be used. For example, a continuous belt running between the base and the top of the interior compartment and having a bar or shelf projecting therefrom, where the length of the projection is about half of the thickness of a deck of cards, may lift the cards. The structure may have an arched path of the belt neat the top portion so that the cards will be encouraged to move from the side where they were lifted to the other side of the compartment, in the thickness direction.

Figure 8:
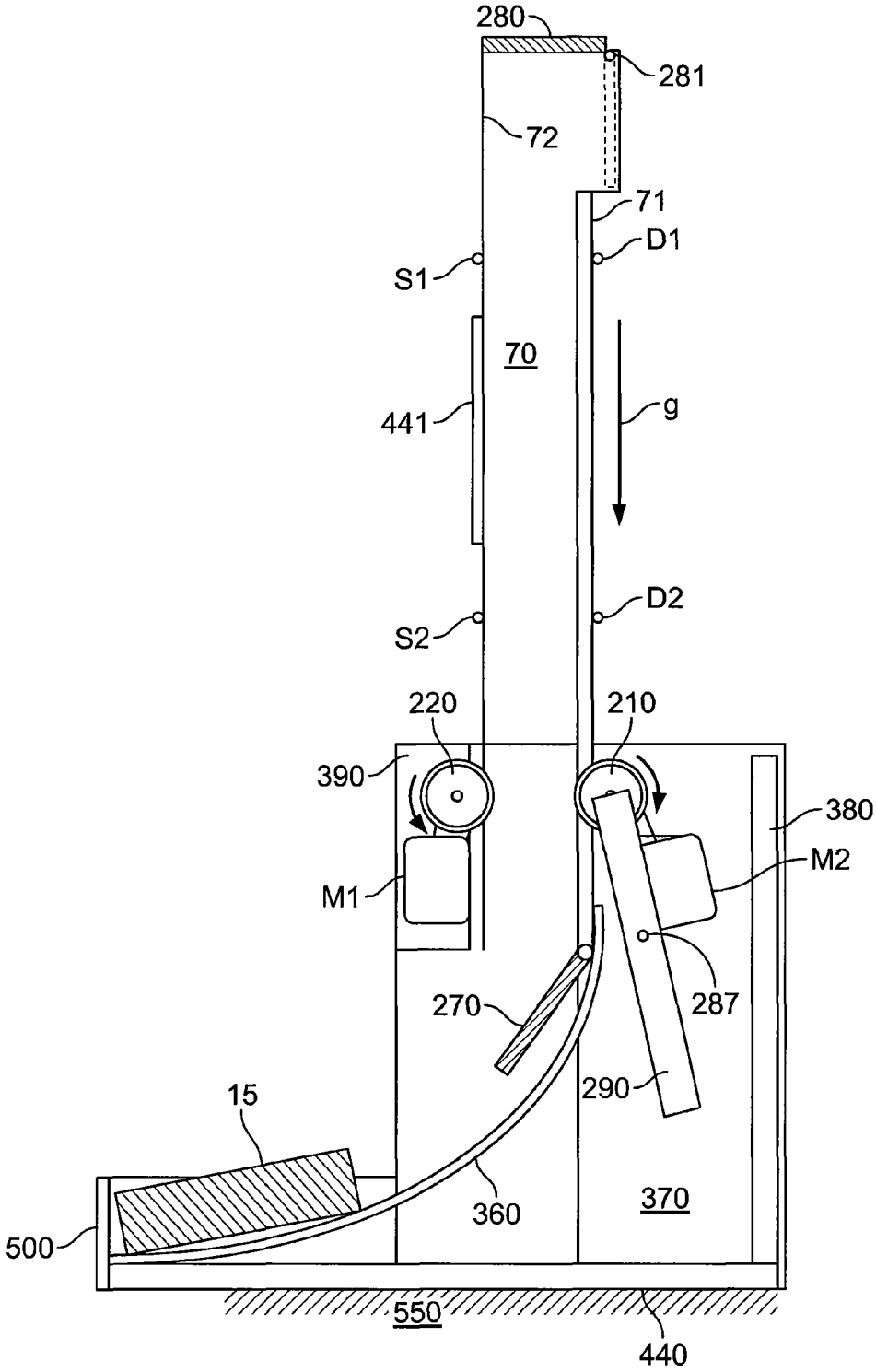
FIG. 8 shows a partial cross section view of an example of a table-top mounted shuffler, with the dispensing flap in an open position and the cards in position to be removed by the user.
Figure 10A:
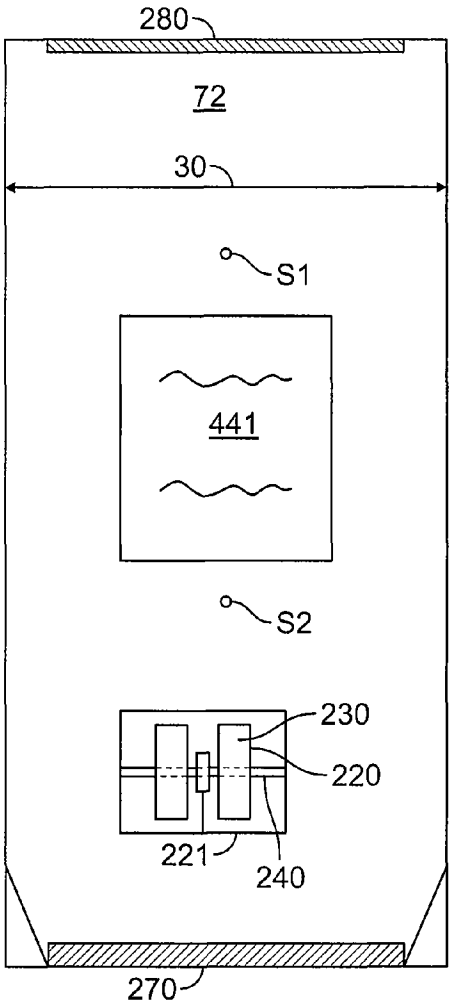
FIG. 10, shows (A) the inside of the front face of the shuffling compartment; (B) a partial cross-section view of the shuffling compartment and associated forcers; and (C) the inside of the rear face of the shuffling compartment.

In another example of a card shuffler, shown in FIG. 8, a shuffling compartment 70, as may be incorporated in a card shuffler 600 providing a stable support. The compartment 70 is positioned with sides 71, 72 oriented in a vertical direction with respect to a tabletop 550 so as to be approximately parallel to a gravity vector g. The height 35 width 30 and thickness dimensions 40 of the shuffling compartment 70 are as shown in FIG. 10. The thickness dimension 40 may be sized so as to accommodate a single deck of cards 15 or a plurality of decks of cards 15, depending upon the type of card game to be played.

Card shuffler 600 may be operated by introducing cards 15 through an aperture at the upper end of the shuffling compartment 70, operating the card shuffler 600, and dispensing the cards at a lower portion 500 of the card shuffler 600. In an alternative arrangement, the cards 15 may be both introduced and dispensed at the top of the card shuffler 600, and such structures may be adapted so as to be mounted to a table top such that only a top opening of the shuffling compartment 70 is visible to the user. In another aspect, shown in FIG. 8 the card shuffler 600 may be may be positioned on a table top 550 during the entire sequence of operations for shuffling the cards 15.

The top aperture of the shuffling compartment 70 may be closed by a door 280 that is urged into the position shown by the solid line by a spring, counterweight, or other mechanism, and the door may swing into a vertical position, shown by the dotted line so as to admit the cards 15 into the interior of the shuffling compartment 70. The side of the compartment facing the dotted representation of the door 280 may provide clearance for the door, although this may not be needed, depending on the cross sectional dimensions of the top of the shuffling compartment 70.

Figure 10B:
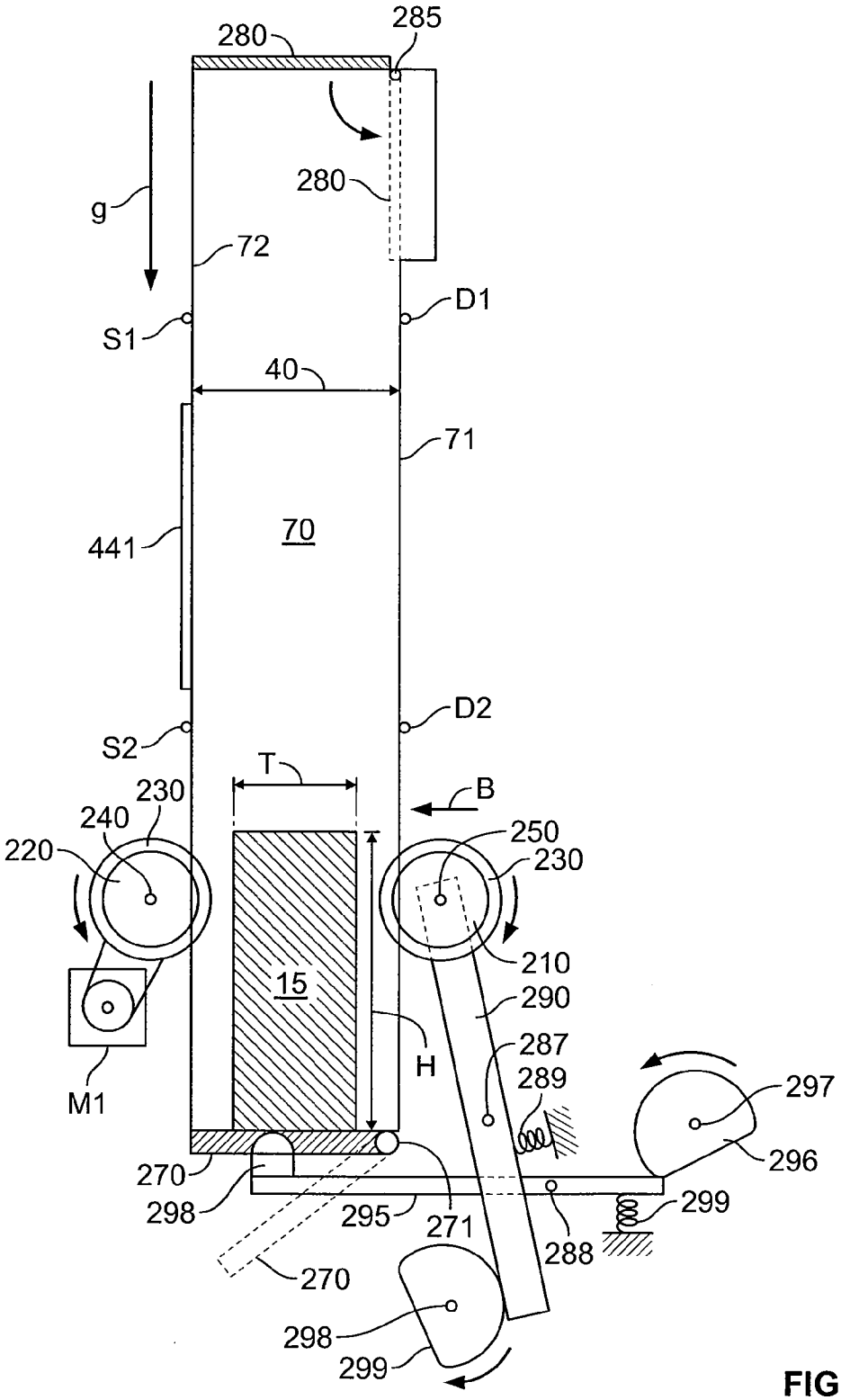
Figure 10C:
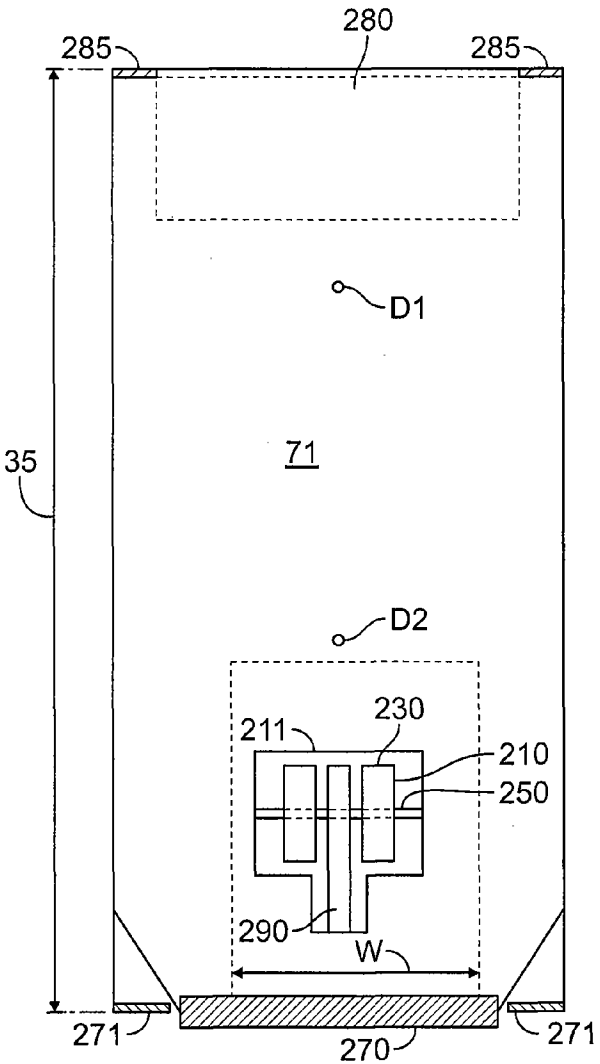

As shown in FIG. 10B, a deck of cards 15, which may be one or more decks of playing cards, has been introduced into the card shuffler 600 and the cards have fallen to the bottom of the shuffling compartment 70. The position of the cards 15 as shown may be before or after a shuffling operation is performed. The structure may be made of any suitable engineering material, such as plastic, which may be polycarbonate, PMMA (poly methyl-methacrylate); metal stock; sheet metal; composite materials, or the like, or combinations thereof, which has been molded, machined or formed, or the like. A transparent window 441 may be formed in the shuffling compartment 70 so that, when the cards 15 are being shuffled, a person may visually confirm that the shuffling operation is being performed. This will also confirm that the cards have been placed in the card shuffler 600 and disposed so that the faces of the cards are not viewable, so as to avoid disclosing card the card suits and values. The window 441 may be a simple rectangular structure, or may be partially obscured so as to form an ornamental design, such as cut-outs showing the suits of the deck.

The cards are effectively randomized by the actuation of forcers 310, 320 and 298, whose operation will later be described in detail. The act of effectively randomizing the cards will herein be termed shuffling.

At rest, the shuffled deck of cards 15 is supported by a bottom surface 270 of the shuffling compartment 70, and the bottom surface 270 may be rotatable about an axle 271 so as to be in the position shown by the solid line representation, so as to support the cards of the deck of cards 15 in an orientation where the face of a card is in a vertical alignment. In this state, the bottom surface 270 retains the cards in the shuffling compartment 70 until a dispensing operation is performed. As shown in FIG. 8, a dispensing operation may be performed by swinging the bottom surface 270 to the dashed position so that the cards of the deck of cards 15 exit the shuffling compartment 70 and fall downward so as to come in contact with the glide slope 360 that directs the cards towards a stop 550 where the cards are exposed, so as to be removable by the user. Providing that the face of the cards 15 having distinguishing suit and value markings are oriented so as to oppose surface 71 of the shuffling compartment 70, the deck of cards 15, as dispensed against the stop 500, will be positioned so that the face of the cards is downward, and not exposed to view.

Figure 9:
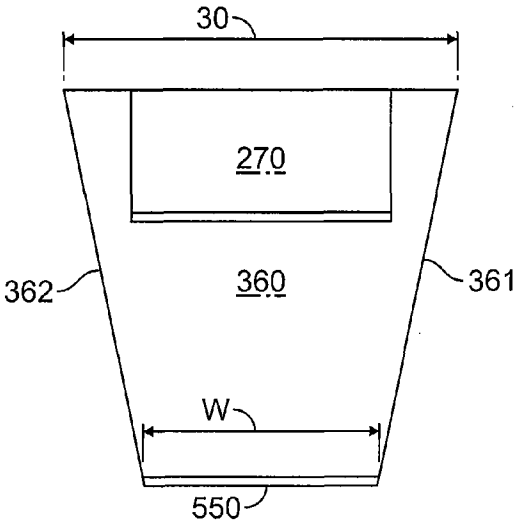
FIG. 9 is a detail of the example of FIG. 8, showing the glide slope for dispensing cards, as viewed from the front of the device.

As shown in FIG. 9, the glide slope 360 may have side portions 361, 362 to restrain the cards 15 as the cards descend the glide slope 360. In an aspect, the side portions 361, 362 of the glide slope 360 may be disposed parallel to each other. In another aspect, as shown in the front view of FIG. 9, the sides 360, 361 may be closer together at stop 500 that at the top of the glide slope 360. The width of the glide slope 360 may be approximately equal to that of the width 30 shuffling compartment 70 at the top of the glide slope 360, and be closer in dimension to the width W of the cards 15 at the stop 500. This would tend to consolidate the deck 15 in the width direction as it slides down the glide slope 360. Since there are several different sizes of cards in use, such a bridge or poker cards, the dimensions selected may be governed by the type of cards being used, or a larger dimensional tolerance provided. In an alternative, the converging sides, as shown in FIG. 9, may be a removable structure (not shown) that can be inserted by the user if desired to accommodate different sized decks of cards.

Other aspects of the card shuffler that may be seen in FIG. 8 are a machinery compartment 370 that may house the electronics 380, the motors M, and portions of the mechanism (not shown) for operating the bottom surface 270, the forcer 310, and the forcer 298. The electronics may be provided on one or more printed circuit boards 380 having a microprocessor, field programmable gate array (FPGA) or any type of digital processor having the capability of being programmed by a stored program, whether the instructions are stored internally to the processor, or in a separate memory circuit such as a FLASH chip, a PROM (programmable read only memory) EEPROM, or the like. The electronics 380 may also include interface circuitry to effects the control of the motors M, and receive inputs from sensors, as will later be described, for determining the presence of cards 15 at a suitable location, for counting cards, and for providing interaction with a user.

The shuffling operation may be, for example, automatically initiated upon sensing the introduction of cards 15 through the top aperture and the subsequent presence of the cards 15 near the bottom surface 270 of the shuffler. In an alternative, the shuffling operation may be initiated by pressing a button on the card shuffler 600. Similarly, the cards may be dispensed through the bottom surface 270 at the conclusion of the shuffling operation, or when a button is pushed by the user.

The shuffling operation may be performed in a time period of from about 10 to about 15 seconds duration. This time duration was determined experimentally by utilizing a deck of cards that was marked with a bar-coded version of the card value so that the card sequence of a shuffled deck could be easily recorded when the deck had been shuffled using the mechanism described in this example. In the experiments, conducted with a prototype device, the start and stop of the shuffling cycle were controlled manually, as was the dispensing of the cards. The duration of the shuffling was considered to be sufficient to effectively randomize the cards based on an analysis of the relative positions of individual cards, the lack of clumping, and other similar criteria. Similar tests can be repeated during initial production of the card shuffler 600 so as to select an appropriate value. Other values of the shuffling time may be selected.

Compartment 390 may house a motor M suitable for driving the forcer 320. A variety of motors are suitable for this purpose, and the prototype shuffler used a FK-280PA-18165 carbon-brush motor from Mabuchi Motor Co. Ltd., Matsudo City, Chiba, Japan. The forcer 320 was driven through a belt-and-pulley arrangement and the rotation speed was estimated at about 2,000 to about 3,000 rpm. The same or similar motor may be used for the other motors of this embodiment. Alternatively, stepper motors, brushless motors, or any device capable of producing or being translated into motion of a forcer so as to eject the cards in a vertical direction may be employed.

The details of the shuffling mechanism may be understood using FIG. 10 which shows a front interior view (A), a cross section view (B) orthogonal to the front view, and a rear interior view (C). The front view, FIG. 10A shows the observation window 441, the top lid 280 and the bottom surface 270 with respect to the surface 72. Sensor pairs 51, D1 and S2, D2 may be, for example, a light-emitting diode and a photodetector, of a sensor pair, respectively. One of the pair is positioned at the front surface 72 and the other of the pair is positioned at the rear surface 71 (see FIG. 10B) so that an optical path exists between the pairs when there are no cards 15 in the shuffling compartment 70. When cards 15 are introduced into the shuffling compartment 70, the optical path of the upper sensor pair S1, D1 is temporarily interrupted as the cards 15 drop down to rest on the bottom surface 270. This action also interrupts the optical path of the second sensor pair S2, D2.

In the transverse cross section shown in FIG. 10B, the cards 15 are shown resting on the bottom surface 270, such that the thickness T of the introduced cards, which may be a deck of cards 15, is positioned between forcers 310, 320. The thickness dimension 40 is greater than the thickness T of the introduced group of cards 15. Forcers 310 and 320 may be, for example, circular disks, with forcer 310 mounted so as to be rotatable about an axle 350, and forcer 320 may be mounted so as to be rotatable about an axle 340, the card-contacting surfaces 330 thereof facing each other along approximately a plane passing orthogonal to the rotational axes 340 and 350. The peripheral surface 330 may be formed on each of the forcers 310, 320 using a material that may have some resilience and whose coefficient of friction is selected to enable the forcers 310, 320 to eject cards of the deck of cards 15 in a vertical direction.

The prototype device used a custom-manufactured O-ring made from white EPDM (ethylene propylene diene Monomer (M-class) rubber) material, with a durometer value of 60, as the peripheral surface 330. The white color was selected so as to minimize card marking, and the durometer value was found to result in a material that is sufficiently durable, while providing a satisfactory coefficient of friction. The outer diameter of the circular disk with the O-ring as the peripheral surface was approximately ⅝ in. An O-ring of this size and material did not appear to be commercially available, and a custom product was purchased from O-Rings West, Inc, Seattle, Wash. If available, an extruded hose of such a material may be sectioned so as to form flat rings that may also be suitable.

The surface 330 may not be needed, depending on the choice of material for the forcers 310, 320. One of the forcers, for example forcer 320, may be mounted to an axle 340 that is fixed with respect to the remainder of the card shuffler 600, so that the forcer 310 may be driven in the rotational direction shown by the arrow by a motor M. The motor M (shown in FIG. 10B) may be coupled to the axle 340 by a gear train, a belt drive, or other mechanical coupling of rotary motion, as is known in the art. The forcer axle 340 is disposed such that the forcer 320 extends into the shuffling compartment 70 by less than the radius of the forcer 320.

The cards 15 are shown as standing upright in the shuffling compartment 70, however, in practice, the outer cards of the group of cards 15 may tilt against the forcers 310, 320 when a shuffling operation is not in progress and forcer 310 is in a retracted position. A clearance distance is provided between the closest surfaces of forcers 310 and 320 such that the separation is greater than that of a deck of cards 15.

In practice, the thickness T of the deck of cards 15 is not standardized in the industry, and a review of product specifications suggests that a total variability of about 38 percent in the value of T may be experienced over the full range of commercially available playing cards. A nominal value of deck thickness T would be about 15.1 mm.

Forcer 310 is mounted to an axle 350 which, in a rest position, is disposed approximately parallel to the axle 340 and at approximately the same distance above the bottom surface 270. The forcer 310 may face a slot 311 in the surface 71 sized and dimensioned so that the forcer 310 may be variably introduced into the shuffling compartment 70. This motion of the forcer 310 may be effected by mounting the forcer 310 to a pivoted arm 290. The arm 290 pivots about axle 287, so that the forcer 310 moves in the direction shown by arrow B.

Forcer 310 may be rotationally driven in the direction shown by the arrow by a motor M. The motor M (not shown in this figure) may be coupled to the axle 350 by a gear train, a belt drive, or other mechanical coupling of rotary motion, as is known in the art. When actuated, the forcer 310 rotates in the direction shown by the associated arrow. The actuation of the motor M, and the introduction of the forcer 310 into the shuffling compartment 70 may be repeated periodically during the shuffling period. A typical repetition period of actuation during the prototype testing was 0.5 sec.

Cards are shuffled by actuating the motors M while pivoting the arm 290 so as to progressively and periodically introduce the forcer 310 into the shuffling compartment 70. Forcer 310 contacts one of the flat surfaces of a card of the deck of cards 15, as the forcer 310 is advanced in the direction of the arrow B. The forcer 310 may press on the deck of cards 15 such that another of the flat surfaces of the deck of cards 15 contacts the forcer 320, which is rotating in the direction shown by the associated arrow. As such, an upward force is applied to at least the flat surfaces of the outermost cards of the deck of cards 15 by the rotation of the forcers 310, 320, such that the cards are ejected upward towards the top cover 280 of the shuffling compartment. More than one card of the cards in proximity to the cards being contacted by the forcers 310, 320 may be ejected in this manner due to frictional forces between adjacent cards.

The pivot arm 290 may continue to introduce the forcer 310 into the shuffling compartment 70 so as to maintain contact between the forcers 310, 320 and the outermost of the remaining cards during each forcer cycle. During this sequence of operation some or all of the cards of the deck of cards 15 in the rest position may be ejected in the vertical direction. The exact number of cards is not significant, as the operation will be repeated.

The ejection operation may be repeated a plurality of times. The actuation of the pivot arm 290 may be by a cam mechanism 299, affixed to an axle 298. The axle 298 may be mounted to the card shuffler 600 so as to have a fixed location, and when the cam 299 is rotated in the direction shown by the arrow, the cam 299 bears against an end of the pivot arm 290 distal from the axle 350 to which the forcer 310 is mounted. The motion of the pivot arm 290 associated with the operation of the cam 299 is such that the forcer 310 is introduced into the shuffling compartment 70.

As the cam rotates, the pivot arm 290 is held in contact with the cam 299 for at least a portion of the rotation thereof by a spring 289. The spring 289 is shown as a compression spring bearing against a fixed surface of the card shuffler 600. However, other spring configurations may be used, including tension springs, torsion springs, leaf springs, or the like. Any structure or mechanism capable of providing a restoring force may be used; for example, a solenoid.

The operation of the cam 299 and the rotation of the forcers 310, 320 may be coordinated so that the forcers 310, 320 are rotating as the forcer 310 is being introduced into the shuffling compartment 70. When sufficient pressure is applied to the outer surfaces of the cards of the deck of cards 15, cards will be ejected from the deck of cards 15 in the upward direction. In an alternative, the forcer 310 may be introduced into the shuffling compartment 70 so as to apply a force to the outer surface of the facing card, and to press the opposing card against the forcer 320 prior to rotating the forcers. In an aspect, the shuffling operation may be interrupted or varied in intensity so as to facilitate the consolidation of the ejected cards into the cards resting on the bottom surface 270.

Experimentally, when the cards are ejected as described, the ordering of the cards in the deck of cards 15 is changed, and the inventor has observed that a rapid repetition of a sequence of ejections over a period of about 10-15 seconds is sufficient to effectively randomize a single deck of cards 15.

The width 30 of the compartment 70 may be selected so as be slightly greater than the smaller of the two planar dimensions of the cards, so that, while the card may experience some rotation about an axis orthogonal to the plane of the card, the orientation of the cards is unchanged in rotation after the shuffling operation. Alternatively, the cards may be oriented so that the long dimension of the planar surface is parallel to the base 550. In this circumstance, the dimension 30 needs to be chosen so that it is less than a diagonal dimension of a card, so as to prevent unwanted rotation of the cards.

The height 35 of the shuffling compartment may be chosen so that the cards are ejected so as to at least clear the tops of cards at rest. This places a lower limit on the height 35 of twice that of the planer dimension of the card in the direction of ejection. Generally a height equal to about three times the planar dimension on the direction of ejection would be satisfactory. A greater height would permit more vigorous ejection without excessive banging of the cards against the top cover 280.

Figure 11:
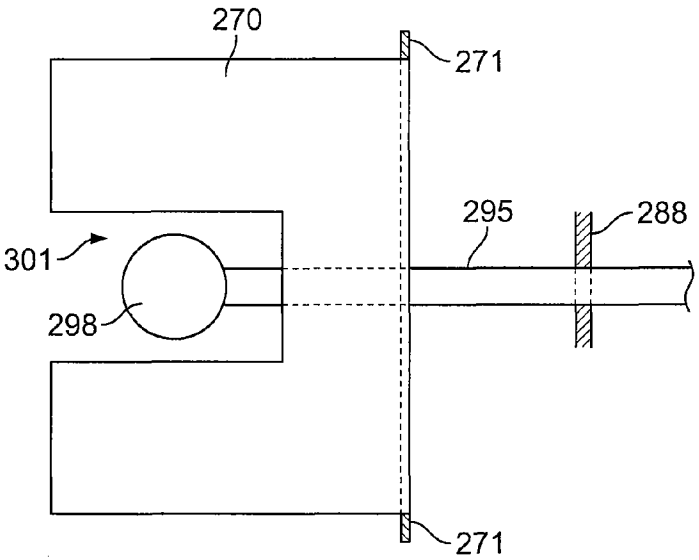
FIG. 11 shows a detail of the bottom flap of the shuffling compartment of the example of FIG. 8.

Since the cards can rotate somewhat about axes through the plane of the card, some further assistance may be required so that the cards settle back into essentially the position shown in FIG. 10B. This may be provided by a tapper forcer; for example, a boss 298 mounted to a pivot arm 295, where the pivot arm 295 is rotatable about an axle 288 having a fixed orientation with respect to the card shuffler 600. A cam-follower arrangement similar to that used for pivot arm 290 may be used, comprising cam 297 and restoring spring 296, with the cam 297 being actuated by a motor M. The boss 298 may project through an aperture 301 formed in the bottom surface 270, as shown in the detail of FIG. 11. The tapper forcer mechanism, comprising the tapper, the pivot arm 295, the axle 288, restoring spring 299, and the motor M, or equivalents, may be mounted so that all or part of the tapper mechanism rotates with the bottom surface 270 about the axle 271. The axle 271 is mounted to the shuffler apparatus 600. Alternatively, the bottom surface 270 may be actuated to provide an impulsive or vibratory input force with a vertical component.

A mechanism (not shown) opens and closes the bottom opening of the shuffling compartment 70. The bottom surface 270 is shown in the closed position in FIG. 10B as a solid line structure, and in FIG. 8. The opening of the aperture in the bottom of the shuffling compartment 70, by the rotation of the bottom surface about the axle 271, dispenses the cards from the shuffling compartment 70 onto the glide slope 360. The weight of the cards may be used to assist in the opening of the aperture, and the aperture closed again without the weight of the cards bearing on the bottom surface 270. The bottom surface may be restrained in the closed position during the shuffling process by a latch mechanism.

The sensor pair S2, D2 may be used to confirm that the deck of cards 15 has been shuffled, and is in a state where the cards of the deck 15 are resting on the bottom surface 270 of the shuffling compartment 70. Should the sensor optical path be blocked after completion of the shuffling cycle, this state may be taken as an indication that a card remains in a rest position above the top of the remainder of the deck of cards 15. This condition may be considered undesirable, and the shuffling cycle may be automatically repeated, at least in part, prior to dispensing the cards to the user. For example, one of the shuffling operations comprising rotating the forcers 310, 320 and advancing the forcer 320 into the shuffling compartment, and operating the tapper for a period of time may be performed. Since the cards have been previously shuffled, the purpose of this action is to complete the compaction of the deck prior to dispensing the shuffled deck of cards 15 to a user.

The forcers 310, 320 may be circular disks fixedly mounted to a rotatable axle 340, 350, each axle being driven by a motor or other mechanism. The width of the contact face 330 may be selected, so as to apply the force over a surface area of the card. Similarly, a plurality of disks, mounted to a common axle may also be used. The peripheral surface 330 of the forcers may be faced with a material whose properties are selected to be compatible with applying force to the surface of a card.

Figure 12:
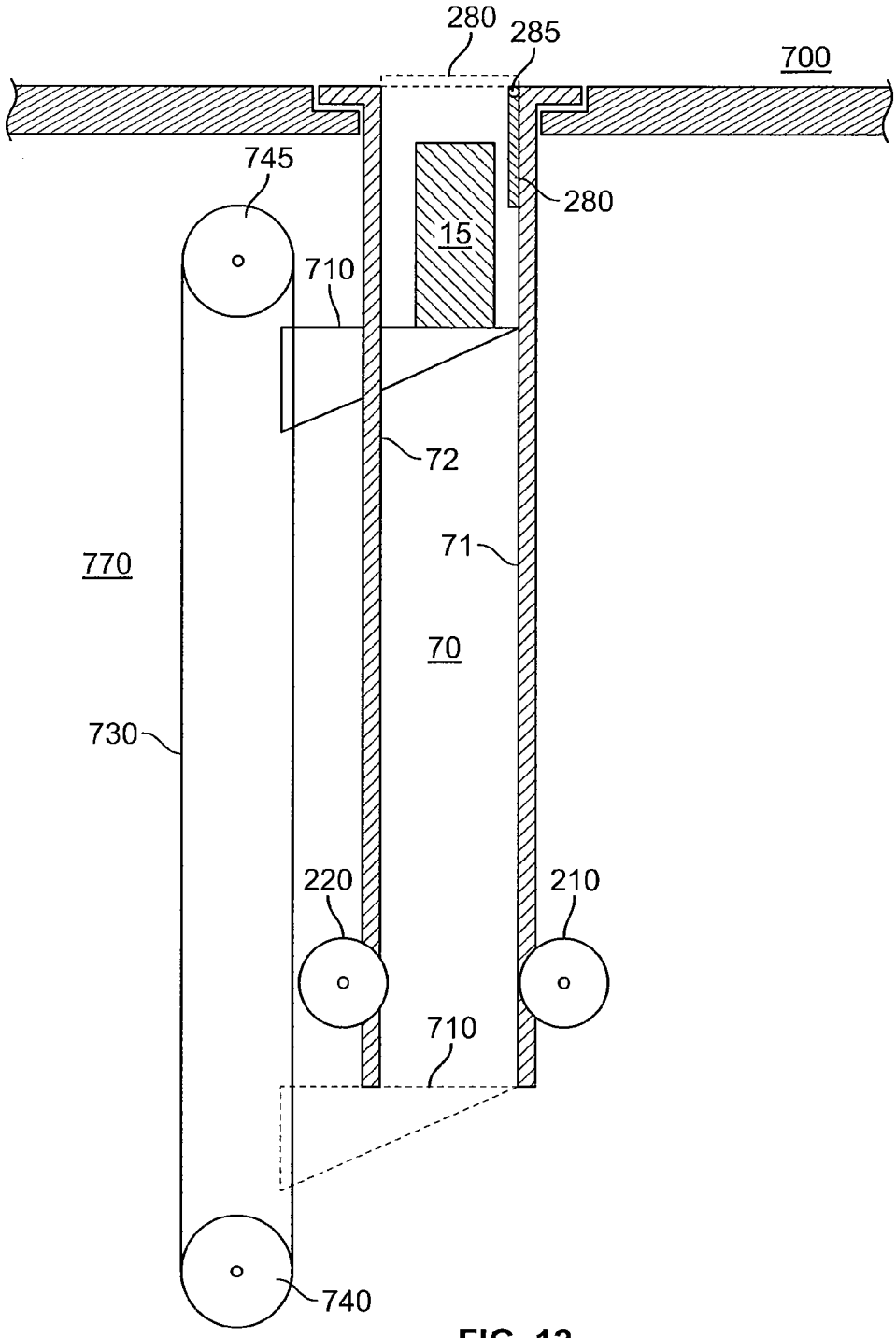
FIG. 12 shows a partial cross section view of the shuffling compartment and the elevator mechanism for a version of the shuffling device of FIG. 8 that has been adapted to mount to a table top.

In another example, the shuffling chamber 70 may be adapted to be mounted beneath a table. FIG. 12 shows selected aspects of the card shuffler 600, which have been modified so as to permit mounting of the shuffler to a table top 700. Certain aspects of the shuffler device of FIG. 8 have been retained in the drawing so as to make clear the physical arrangement of the shuffling compartment 70 with respect to the table top 700, and to additional or modified aspects of the shuffler design.

In particular, the compartment 70 corresponds to that of FIG. 8 in cross-section. The width, thickness and height of the compartment 70 are determined using the same design considerations as before. A deck of cards 15 is inserted into the shuffler compartment 70 and removed from the shuffler compartment 70 through the aperture at the top thereof. The table top 700 is prepared by forming a hole in the top, suitable to accommodate the aperture 281 of the shuffling compartment 70. As shown, the top of the compartment 70 may be formed with, or attached to, a lip 75 that supports the remainder of the apparatus with respect to the table top 700. Of course, the shuffler may also be supported by brackets or clamps, or the like, attaching to the underside of the table. The aperture cover 280 is shown in an open position, having been pushed downward by a force, such as would be encountered during the introduction of a deck of cards 15 through the aperture 281. The alternate position of the aperture cover 280 is shown as a dashed-line structure.

After being shuffled by the same process as was described using the example of FIG. 8, the deck of cards 15 may be dispensed to the user through an aperture in the table top 700. In this example, the same aperture 281 is used for inserting and dispensing the cards. Alternative arrangements will be evident as a result of this description and related comments, and in another example.

As the cards are no longer dispensed through the bottom of the shuffling compartment 70 in this example, the bottom surface thereof does not swing downwards so as to permit the cards to fall out of the shuffling compartment 70. Rather, the bottom surface of the shuffling compartment 70 is a platform 710 that may be actuated by an elevator mechanism 770 so as to raise the deck of cards 15 from the bottom of the shuffling compartment 70 to the top of the shuffling compartment.

Figure 14:
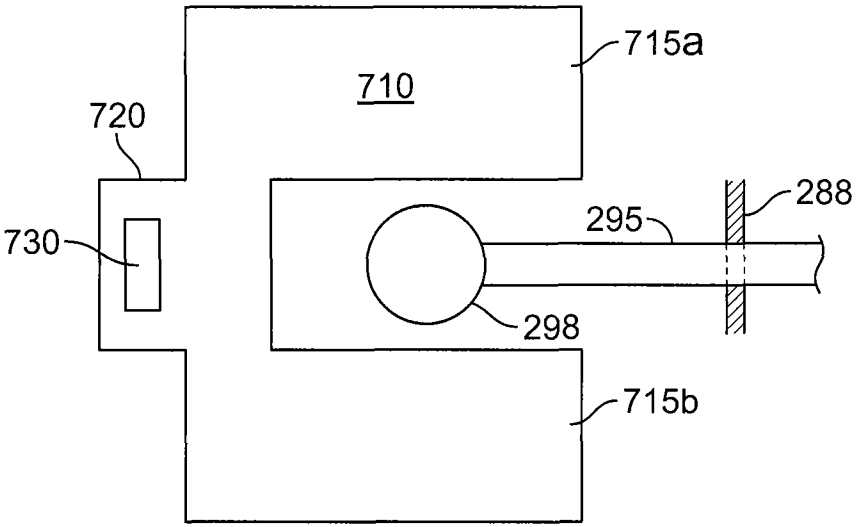
FIG. 14 shows a detail of the bottom card support of the shuffling compartment for the table top mounting version of FIG. 12.

An example of an elevator mechanism 770 may be a sprocketed drive 745 and idler 740 and a mating belt or chain 730, to which a lifting platform 710 is attached by a fixture 720. As shown in FIG. 14, the platform 710 is bifurcated so as to form an aperture through which the tapper 298 may extend so as to perform the same consolidating function as in the previous example. The platform 710 may have finger-like projections 715*a* and 715*b* dimensioned and spaced so as to support the deck of cards 15 when the deck of cards 15 is either resting on the lifting platform 710, or returning to the lifting platform as part of the ejection process previously described. The positioning of the fingers 715*a* and 715*b*, and the width of the fingers may be suitable for supporting the deck of cards 15, but need not support the deck of cards 15 across a substantial portion of the edge of the cards resting on the fingers. One may consider the situation to be similar to that of the tines of a fork lift in an industrial application, where the tines are symmetrically spaced, but are much longer than they are wide. Once having met the needs of providing support to the cards, and preventing cards from slipping around the support structure so as to fall out of the mechanism, the details of the platform would be governed by considerations related to the construction, such as the stresses placed on the remainder of the elevator mechanism 770, and clearance with respect to other structures.

As the bottom of the shuffling compartment 70 is now formed by the platform 710, the tapper forcer mechanism 298, 295 and the associated axle 288, restoring spring 299 and actuator (motor, solenoid) may be mounted in a fixed arrangement with respect to the remainder of the apparatus, as the tapper assembly does not interfere with the dispensing.

Figure 13:
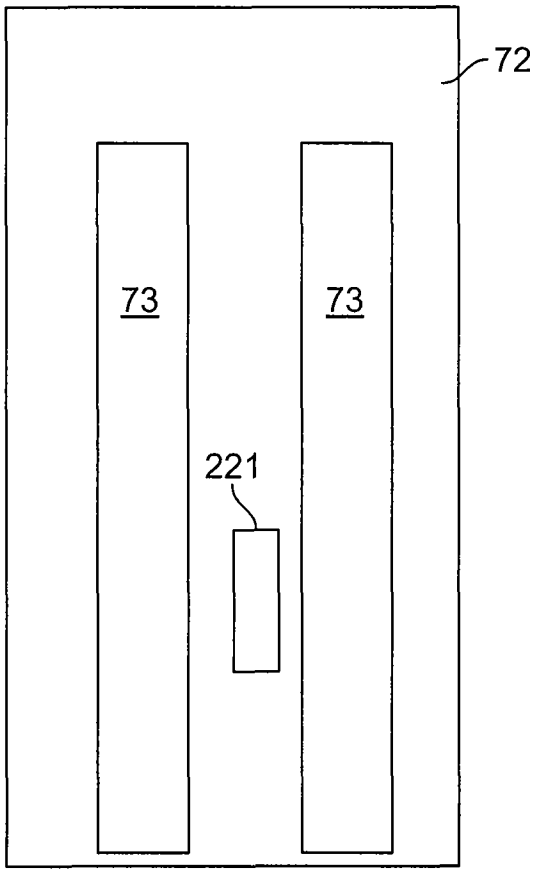
FIG. 13 shows the inside of the front face of the shuffling compartment for the table top mounting version shown in FIG. 12.

To permit the platform 710 to extend into the shuffling compartment 70, and to lift the deck of cards 15 from the bottom of the compartment to the top of compartment near to the table-top aperture, the side 72 of the shuffling compartment 70 facing the elevator mechanism 770 is provided with apertures 73 and 74 (as shown in FIG. 13) so as admit the tines 715 of the platform 710. This permits the platform 710 to be moved by the elevator mechanism 770 from the bottom of the compartment 70 to the top of the compartment 70. The deck of cards 15 and the platform 710 are shown in the elevated position as a dashed structure.

Also shown in FIG. 13 is a slot 321 through which the forcer 310 may project into the shuffling compartment 70 through the vertical wall 72. The shape and location of the platform and that of the forcer 310 are therefore coordinated such that the platform 710 has a clearance with respect to the forcer 310 and the associated drive and mounting mechanisms as the platform is raised from the bottom of the shuffling compartment 70 to the top of the shuffling compartment 70.

The details of the arrangements of the elevator mechanism 720 and the top of the shuffling compartment 70 may vary, as the user requirements for the removal of shuffled cards may be different. The dispensing portion of the shuffler should be designed so as to avoid exposing any of the cards to the view of any player of the game of cards. This is particularly true of the bottom card in the deck.

An example of a manual method of dispensing the card from the shuffling compartment 70 is shown in FIG. 15*a, b, c*. The dispensing device 900 is hand held and may be inserted into the top of the compartment 70 through the aperture 281. The exterior cross-sectional dimensions of the dispensing device 900 may be slightly smaller than those of the compartment 70, so that the device 900 may be slid into the compartment 70 through the aperture 281. This is accomplished by pressing the end of the dispensing device 900 that is distal from the handle 919 against the hinged cover 280. After the cards had been previously introduced into the compartment 70, the aperture cover 280 had returned to a horizontal position by rotating about the axle 282 such that the aperture cover 280 was horizontal during the actual shuffling process. This may have been accomplished by a spring mechanism, which may be a torsion spring, by a motor, or the like.

Pressing the distal end 990 of the dispensing device 900 against the face of the aperture cover 280 causes the aperture cover 280 to fold into the position shown in FIG. 12 by the dashed line, where the aperture cover 280 is in a vertical orientation. In this state, the dispensing device 900 may be slid into the compartment 70.

The interior dimensions of the dispensing device 900 are about equal to at least the height H, the thickness T and the width W of the deck of cards. The illustration in FIG. 14*a* is of the dispensing device 900 when the deck of cards has already been introduced thereto. The deck of cards is seen to be positioned such that a top of the deck of cards is exposed to view, and may be removed from the dispensing device with the aid of clearance gaps 920 which permit the users fingers to grip the cards. Other similar arrangements may be envisaged.

The elevator mechanism 770 is operable to raise the shuffled deck of cards 15 such that the top edge of the deck of cards 15 is positioned slightly below the table surface 700. The distance is such that the introduction of the dispensing device 900, having the effect of forcing the aperture cover 280 into a vertical orientation, may be performed without interference from the deck of cards 15 that is near the top of the shuffling compartment. That is, the deepest penetration of the aperture cover 280 into the compartment 70 is less than the distance that the top edge of the deck of cards 15 is positioned below the closed position of the aperture cover 280.

Alternatively, the dispensing device 900 would be introduced into the compartment 70 before the cards were raised to the vicinity of the aperture 281, and the act of raising the cards may then also insert the cards into the dispensing device 900.

The dispensing device 900 may be inserted into the compartment 70 so that the top edge 995 of the dispensing device 900 is approximately flush with the table. A stop, which may be a projection from the interior wall of the compartment 70, may be used to limit the distance of insertion of the dispensing device 900 into the shuffling compartment 70.

The distal end 990 of the dispensing device may be closed by a spring loaded flap 940, rotatable about an axle 950. The rest position of the flap 940 is as shown in FIG. 15*a*, having the effect of closing the distal end 940 of the dispensing device 900. When a deck of cards 15 is present in the interior of the dispensing device 900, the flap retains the deck of cards 15 so that the cards may not exit the dispensing device except through the aperture 925.

When an empty dispensing device 900 is inserted into the compartment 70 through the aperture 281, and pushed down so that the proximal end 995 of the shuffling device 900 is approximately flush with the table top 700, the deck of cards 15 that had been positioned just below the aperture 281 will press against the flap 940, moving the flap into a vertical position, as shown in FIG. 15*b*. In this state, the deck of cards 15 is at least partially within the dispensing device 900, and the flap is essentially in a vertical position. Depending upon the relative dimensions of the dispensing device 900 and the position of the deck of cards 15, the elevator mechanism 770 may be actuated by a sensor switch (not shown) such that the elevator raises the deck of cards 15 such that a bottom edge of the deck of cards 15 is raised to a position that is higher that the topmost position of the flap 940, when the flap is in the vertical direction. At this juncture, the flap 940 is no longer restrained by the deck of cards 15, and returns to a horizontal position, as shown in FIG. 15*a*, such that the deck of cards 15 is fully within the dispensing device 900 and restrained therein. The dispensing device 900 may now be removed from the shuffling compartment 900, permitting the aperture cover 280 to return to a horizontal position.

The dispensing device 900 may now be placed on the table 700 in a position where the top of the deck of cards is horizontal, and the cards may be removed from the card dispenser 900.

In another aspect, the card shuffling device and method may also include the ability to count cards by the number of cards in the deck of cards, or by the individual values of the cards of the deck. This may be useful to automatically ascertain that a complete deck of cards is being used, whenever a deck of cards has been shuffled. The number of cards, or the number of cards of each value and suit that would be considered to be a complete deck of cards may vary with the type of card game being played, and the device would have to be programmed accordingly. However most games of cards in the United States are played with a deck of 52 cards, divided into 4 suits, and with well known value designations.

Figure 16:
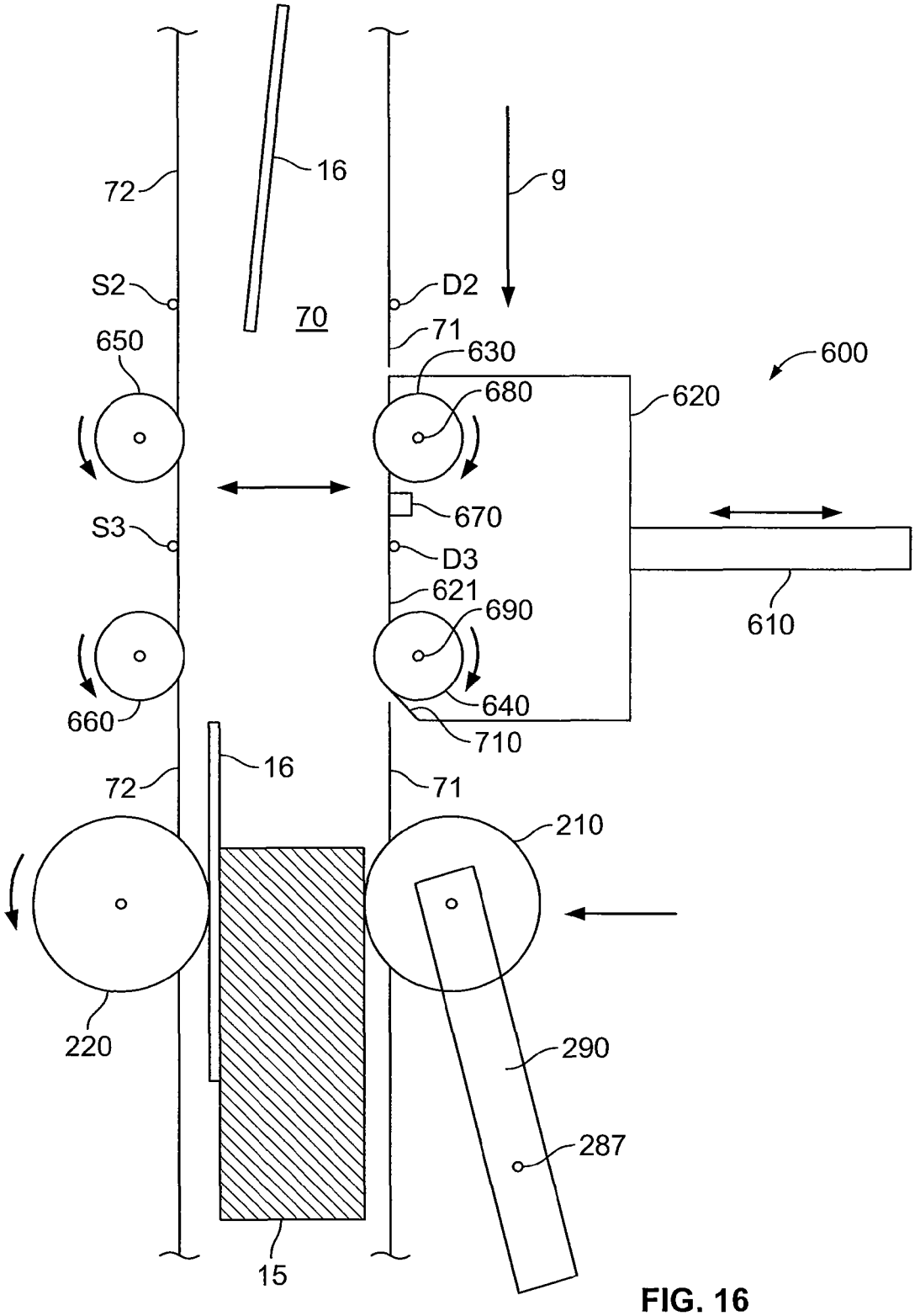
FIG. 16 shows a partial cross section view of the shuffling compartment and a card counting device, when the shuffler is configured for, and is in the process of, counting cards of a deck of cards.

The card counting device may be incorporated into the card shuffling apparatus. In the device shown in FIG. 8, the card counting device may be positioned between the top of roller 220 and the card sensor pair D2, S2. An example of such a device is shown in FIG. 16, where a detail cross sectional drawing shows the device 600 disposed in the vertical shaft 70 of the card shuffling apparatus.

The device 600 may have a carrier 620, capable of being moved horizontally by shaft 610 such that a face 621 thereof may be positioned within a little more than a card width from the surface 71 of the vertical shaft 70 of the shuffling apparatus when in an operational state. When the device 600 is not being used, such as when the shuffling apparatus is being used to shuffle a deck of cards 15, the shaft 610 moves such that the carrier 620 is translated to the right and the surface 621 is approximately flush with the side wall 71. In this position, the cards ejected upwards by the shuffler during the shuffling process are not impeded. The shaft 610 may be any of a variety of mechanical contrivances that would be employed by a person of skill in the art, and may include a lead screw, scissors jack, belt drive, solenoid, or the like. Support and guide elements associated with the motion of the carrier are not shown, for clarity.

Figure 15:
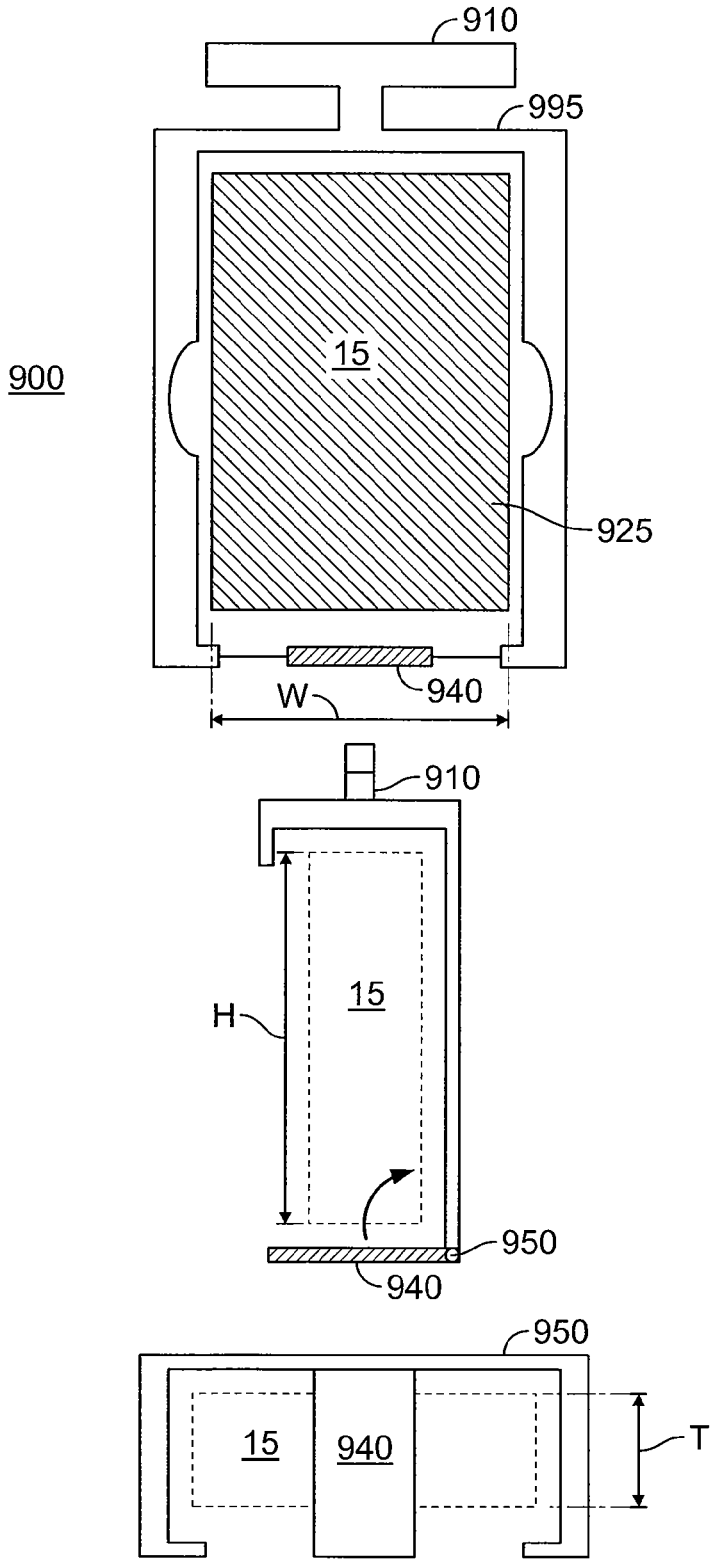
FIG. 15 shows an example of a manual dispensing device for use with the table top mounted shuffling device of FIG. 12

Rollers, 660, 650 are set into apertures of the wall 72, either as individual rollers, or a pairs of rollers, such as shown in FIG. 10A. Rollers 660 and 650 are driven in a counterclockwise direction by a motor, as shown in FIG. 15. The rollers may be individually driven, or the combination of rollers 660 and 650 may be driven by the same motor using a belt or other drive mechanism. Generally the two motors will be driven at the same rotational speed, although it is possible to use differing drive speeds, particularly where the upper roller 650 is driven at a slightly higher speed than the lower roller 660. The function also be performed by a single motor.

The rollers are positioned such that a small segment of each roller protrudes through the wall 72 and would contact a card 16 of the deck of cards 15 should the card be in the space between the wall 621 of the carrier and the wall 72 of the vertical shaft 70. Rollers 630, 640 are affixed to the carrier 620 so that the roller 630 is at the height of roller 650 and the roller 640 is at the height of the roller 660. The rollers 630, 640 may be either single rollers of pairs of rollers, similar to 650, 660. However, a single rollers 630, or 640, may, for example, oppose pairs of rollers 650, 660. The opposing rollers may have a differing widths and diameters. Rollers 630 and 640 may be non-driven rollers. The rollers may rotate about axles 680 and 690. The rollers may be configured to rotate freely about the axles 680, 690, or to offer resistance to rotating so as to act as a frictional force on a card passing between, for example, roller 640 and roller 660. Rollers 630 and 640 may be mounted so that, should the rollers 630, 640 encounter a force applied in a direction parallel to shaft 610, the rollers 630, 640 may deflect in a horizontal direction. This may be achieved by mounting the axles 680, 690 using a spring to position the rollers with a small portion of the roller protruding from the face 621 of the carrier towards the wall 72. Alternatively, the axles 680, 690 may be fixedly but rotatably mounted to the carrier 620 and the entire carrier 620 may be urged into a final extended position, as shown in FIG. 16 by a spring.

In any of these situations, the rollers 630, 640 may have no intrinsic motive power. However, should a card 16 be positioned, for example, between the rollers 660 and 640, the roller 640 will urge the card 16 in an upward direction while at the same time forcing the card against the roller 640, providing that the gap between the outermost projections of each of opposing rollers is less than the thickness of the card 16. When the card 16 is between the rollers 640, 660, the card is moved in the vertical direction by the frictional force applied by the roller 660 acting against the roller 640. Moreover, the roller 640 is urged to rotate in a clockwise direction by the frictional force applied by the moving card 16. The roller 640 may offer a resistance to rotation, so as to act to impede the progress of a second card 16, should a pair of cards be present at the lower portion of the counting device.

Rollers 630 and 640 may be joined by a belt or a toothed drive so as to coordinate the speed of movement and even out the rotational speeds.

In another aspect, the carrier 60 may have a slight chamfer or radius 710 at the bottom entrance the slot between the surface 621 and the surface 72 so as to assist in guiding cards from below into the slot. A sensor pair D3, S3, which may be a light-emitting diode (LED) and a photodetector (PD) may be positioned so that a card traversing the slot from bottom to top will interrupt the light path for a time interval when any portion of the card 16 is present between the sensor pair D3, S3.

The card counter device also makes use of portions of the card shuffling apparatus previously described. In particular, the combination of the rollers 210 and 220 is used to eject a card from the deck of cards 15. During the shuffling operation, as previously described, the carrier 620 is in a retracted position, so that the surface 621 does not protrude into the vertical shaft 70. Hence, the shuffling apparatus, such a shown in FIG. 10B, for example, may operate so as to shuffle a deck of cards to achieve a random distribution of cards. At the completion of the shuffling operation, the deck of cards may be consolidated by operation of the tapper 298 and be a compact assembly of cards 16. The counting operation may be performed prior to moving the cards to a dispensing position. As such, this card counting device may be used in both under-the-table or table top shufflers.

The carrier 620 is advanced into the vertical shaft 70 so as to be in the position shown in FIG. 16. In the counting operation, the operation of the rollers 230, 240 differs from that in the shuffling operation. In an example, the arm 290 may be rotated in a counterclockwise direction by cam 299, or by an ancillary forcer (not shown) so as to advance the roller 230 further into the vertical shaft 70. As the roller 230 advances towards the roller 220, the cards 16 of the deck of cards 15 may be pressed against the surface of the roller 220 by the roller 230 acting on the opposite side of the deck 15. In this state, then the roller 230 is rotated in a counterclockwise direction, and the card 16 in direct contact with the face of the roller 230 will be urged in an upward direction and be ejected from the top of the deck of cards. The speed of ejection would be sufficient to cause the ejected card 16 to enter into the gap between the surface 621 of the carrier 620 and the wall 72. At this time, the top of the card 16 will encounter the opposing roller pair 660, 640, of which the roller 660 is being driven. The card 16 will be pinched between the two rollers and continued to be urged upward, subsequently passing through the second pair of rollers 650 and 630, having similar properties, so as to eject the card 16 into the volume above the top of the carrier 620.

During the passage between roller pair 660, 640 and roller pair 650, 630 the card 16 will obstruct the path between the sensor pair S3, D3 for a time interval set by the speed of motion of the card and the dimension of the face of the card in the direction of motion. Each such interruption may be interpreted by a counting mechanism, which may be a computing device such as a computing device executing a stored program, a firmware programmed device, or a logic array so as to accumulate a count of cards during the counting operation.

As the counting operation proceeds, the roller 230 is advanced further into the vertical shaft 70 so as to continue to urge a face of the card closest to the roller 230 into contact with the roller 230. The roller 230 may be operated in a continuous or interrupted manner so as to produce a relatively steady stream of ejected cards at the bottom of the card counting device. The ejection operation may be stopped from time-to-time and the roller 230 partially retracted so as to permit the tapper 298 to consolidate the cards. However operation of the counter without this consolidation may also be possible.

In an alternative, a scanning bar 670, such as may include a charge coupled device (CCD) scanner, may be mounted to the wall 621 in an aperture thereof, so as to scan the face of the card 16 as it translates past the aperture. The data obtained by the scanning bar 670 may be used to determine the value and suit of each card passing by the sensor. Depending on the direction in which the card is faced, the scanning bar may alternatively be mounted in an aperture of the wall 72.

At the conclusion of the counting process, all of the cards of the deck of cards 15 should be in the region of the compartment 70 that is above the carrier 620. The carrier 620 may then retracted so as to be flush with the wall 71, and the roller 230 may be similarly retracted. During the process of retraction, the cards of the deck of cards 16 fall down so as to rest on the bottom plate 271. The tapper 298, which may be assisted by the rollers 240 and 230 may be used to consolidate the deck into a compact form for further processing. The further processing typically is a dispensing or presentation operation. The details of the further operations depend on the shuffler configuration.

In an aspect, while the roller arrangements described herein are intended to permit only one card at a time to pass between the sensor pair S3, D3, there may be an occasional error where two cards pass through the sensing area in an overlapped fashion, so that only one card count is registered. Such a situation might occur with cards that are not of the expected thickness, or cards where the coefficient of friction is different than expected due to wear, damage, or a foreign substance. Often such an error is not a repeatable event. So, it may be useful, when a count of 51 cards is obtained for a deck of cards where a 52 count is expected, to repeat the counting process at least once, to confirm the error, prior to reporting an error in the card count to the operator. In a casino operation, the reporting of such errors to a central location may be useful in managing the operation. Such reports may be made by wired or wireless means as would be known to a person of skill in the art.

In another example, a user may wish to mount a card shuffling device such as has been described so as to be concealed by a table top of a card playing table where the cards would be introduced into the shuffling device through an aperture in the device that is flush with the table top and, similarly, the cards removed from the shuffling device through the same or a second aperture, and the deck of cards is oriented with a card face horizontal. The choice of a single aperture, a double aperture, and the spacing between the apertures is a matter of ergonomic design and may differ depending on user preferences and the actual use of the apparatus. As an example, a flush mounted shuffling device, using the shuffling apparatus previously described herein is described. The shuffling device may have a card counter incorporated therein, such as was shown in FIG. 16.

Since the shuffling apparatus and method and the card counting device and method have already been described in considerable detail, the description of this example of a flush-mounted shuffling apparatus and method will focus on describing those aspects of the apparatus associated with performing the functions and acts previously described for shuffling and card counting while the shuffler is mounted below a table top.

To the user, the aspect of the shuffling apparatus that remains visible would be an aperture in the table top, which may be fitted with a cover plate. The cover plate may serve to improve the esthetics of the device when cards are not being inserted or removed therefrom, and to minimize the chance that debris or stray cards would be inadvertently introduced into the mechanism. The cover may also be fitted with alarms so that it cannot be opened except during a shuffling operation, and this may be useful to discourage tampering with the device. The cover may be raised manually or automatically or in response to the actuation of a button or other control device by an operator. The present example has a top cover that may be raised during a portion of the operating cycle of the apparatus. In a particular, the cover may be in an open position when a deck of cards that is to be shuffled is to be introduced into the device or when a deck of cards that has been shuffled is to be removed from the device. In an example, the operation of the device may be controlled using a button on the top surface thereof that is pushed by an operator, by a foot switch that is pressed by the operator, or by other equivalent operation device.

When the shuffling cycle is initiated, the top cover opens. Where there may be separate areas for introduction and for removal of cards, a "used" deck may be introduced into the receiving portion of the aperture, and the shuffled deck removed from the "presentation" portion of the aperture. As the top cover is opened, the cards in the presentation portion of the aperture may be raised by an elevator mechanism so such that the lowest card in the deck of cards is about flush with the table to which the shuffler apparatus has been mounted. Other portions of the operator interaction may be automated, including an elevator mechanism for lowering the "used" cards into the apparatus.

Where the same aperture or portion thereof is used for insertion of the "used" cards and removal of the shuffled cards, the shuffled cards may be removed and replaced with the "used" cards.

A table top is prepared by forming a hole in the top, suitable to accommodate the body of the apparatus 1000 so that a cover plate 1012 at least fills the aperture in the tabletop to form an aesthetically pleasing interface.

The "used" cards may be placed in a first portion of the aperture, and the shuffled cards may be removed from a second portion of the aperture. This changed state of the apparatus is sensed, as will be described, and the shuffling operation performed. When the shuffling operation has been completed, the cards are returned to the second portion of the aperture, and an indication of the availability of shuffled cards provided to the operator. The indication may be a light, a sound, or other means of alerting a person.

Figure 17:
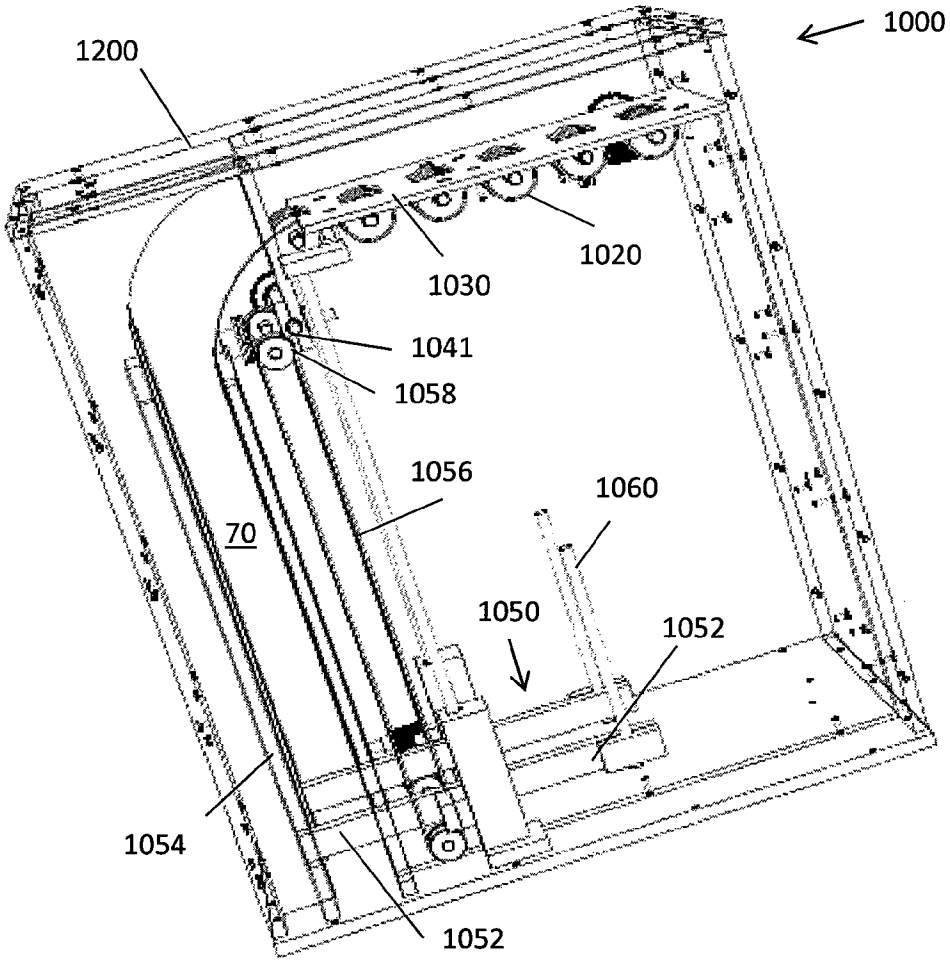
FIG. 17 shows a simplified perspective view of a shuffler configured to be mountable with the dispensing aperture flush with a table top.

FIG. 17 shows a perspective view of the shuffling apparatus. The details of the shuffling mechanism are not shown, but may be understood with reference to FIG. 10B and the discussion thereof, except that the bottom plate 270 of the shuffling chamber is fixed in position, as the deck of cards 15 is transported upwards when the shuffling operation is completed, rather than being dispensed from below the compartment 70.

In particular, the compartment 70 may correspond to that of FIG. 8 in cross-section. The width, thickness and height of the compartment 70 are determined using the same design considerations as before. A deck of cards 15 may be inserted into the compartment 70 and removed from the compartment 70 through the aperture at the top thereof.

A card counting device such as the device shown in FIG. 16 may be positioned in the compartment 70 so as to perform a card counting or identification function.

The perspective view of FIG. 18 omits those functional elements of the shuffler and card counter that have been previously described, as well as many of the belts, motors, sensors, and the like, that are associated with providing he motive force and control inputs needed for the functioning of the overall apparatus, as these would be evident to a person of skill in the art when appraised of the teachings herein.

A top plate 1012 may serve to form an interface with the table top (not shown in FIG. 18) and another plate 1010 may be affixed thereto so as to form a swinging or sliding door in the top plate 1012. The plate 1010 covers an aperture sized so that a deck of cards 15 may be introduced into the apparatus 1000, or be removed from the apparatus 1000. The region where a deck of cards 15 is to be removed may be fitted with an elevator mechanism (not shown) so as to raise the shuffled deck of cards so that a bottom card of the deck of cards is flush with the top surface 1012.

A horizontal card transport assembly may comprise a series of rollers 1020 projecting through a support plate 1030. The rollers may be rotated in unison by a belt, which may be a toothed belt, or a smooth belt. Alternatively the transport mechanism may be a continuous belt, or the like. The horizontal card transport assembly may be actuated so as to move a deck of cards from a right-hand-end of the mechanism to a left-hand-end of the mechanism. In some designs, the belt may also be controllable to also translate in the opposite direction so as to assist in positioning the cards for dispensing. The compartment 70, of which the card shuffling apparatus forms a bottom portion thereof, is positioned at the left-hand-end of the horizontal transport mechanism. An elevator 1050, including horizontal support arms 1052 and a lifting belt 1056 engaging with drive sprockets 1058, may operate similarly to the elevator of FIG. 12, and the horizontal support arms 1052 may be similar in function to the support platform 710.

A pair of vertical shafts 1060 are affixed to the elevator 1050 so that they rise and fall with the motion of the elevator. The function of the shafts 1060 are described later. A lift gate 1100 is rotatable about shaft 1041 from a vertical position to a position about 180° opposed thereto, depending on the state of the shuffling apparatus.

Figure 18A:
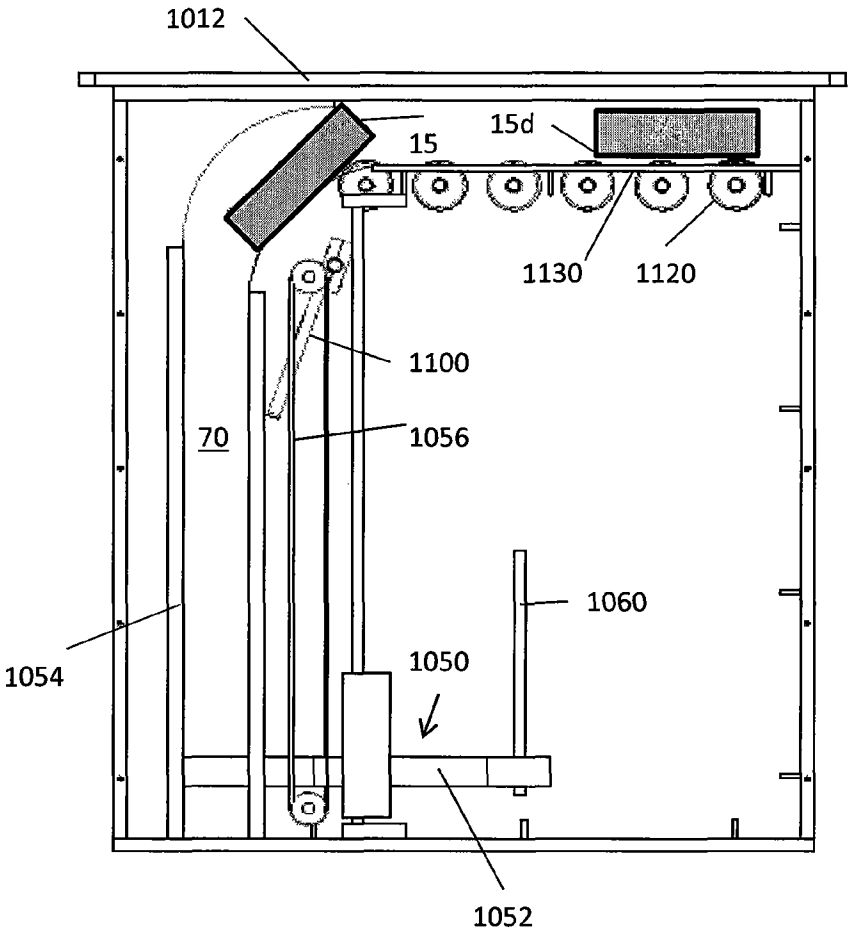
FIG. 18 shows a side cross section view of the shuffler of FIG. 17, with a deck of cards, so as to illustrate states of operation of the shuffler: (A) with the cards inserted in the top aperture of the shuffler being transported so as to fall into a vertically oriented compartment; (B) the cards fallen to the bottom of the compartment; (C) the cards at the bottom of the compartment and the lift gate in a vertical position; (D) the cards raised to the top of the compartment by the elevator and the lift gate in a lowered position; (E) the lift gate rotating so as to lift the deck of cards onto the horizontal transport mechanism, and the retractable stop deployed; (F) the deck of cards positioned on the horizontal transport mechanism preparatory to being removed from the shuffler; and (G) the shuffled cards above the table top and a deck of used cards ready for another shuffling operation.
Figure 18B:
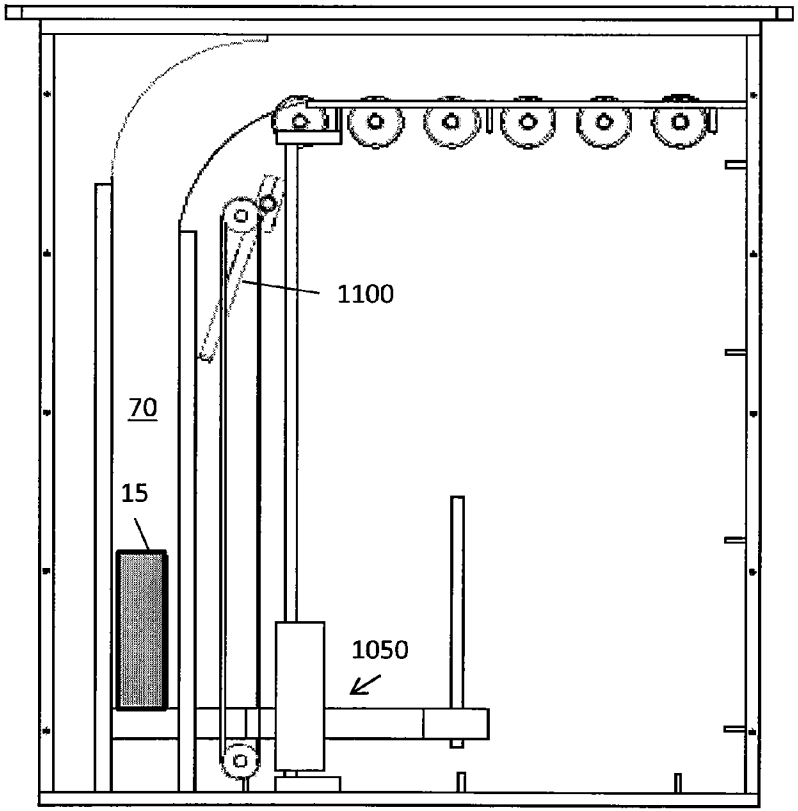

FIG. 18*a* shows a side view of the shuffler apparatus 1000 in a first and a second state. In the first state a deck of cards inserted through the top aperture so as to be positioned as shown for deck 15*d*. The lift gate 1110 is rotated from a vertical position to a position so that it does not obstruct the top of compartment 70. The elevator mechanism 1050 is operated by the activating the moving belt 1056 and lowered so that at least the tops of rods 1060 are below the support plate 1030. The horizontal transport mechanism 1130, 1020 is activated so as to move the deck of cards 15*a* to the left and, after moving to the left-hand-end of the transport mechanism, the deck of cards 15 falls into the compartment 70. If the elevator mechanism 1050 had not previously been moved entirely to the bottom of the compartment 70, it may be moved there now, so that the deck of cards 15 rests on the horizontal arms 1050 at position near the bottom of the compartment 70, analogous to that shown in FIG. 10*b*.

To prepare for the shuffling operation, the gate 1100 may again be raised to a vertical position. Alternatively, depending of the height dimension of the compartment 70 and the height to which the cards are ejected during the shuffling operation, the lift gate 1110 may be left in the position shown in FIG. 18*b*.

Figure 18C:
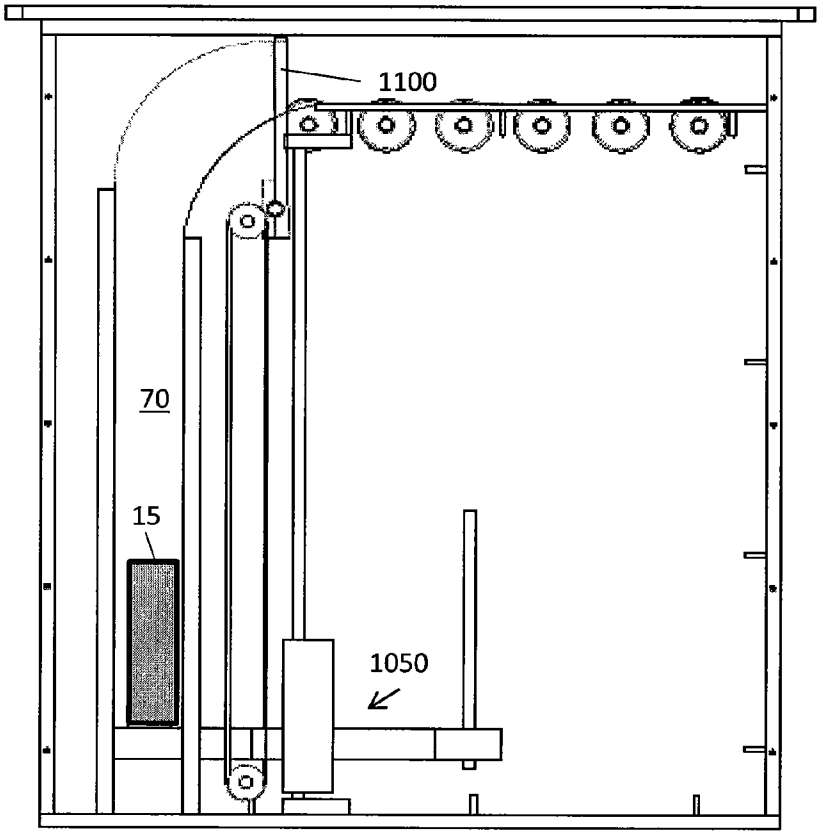
Figure 18D:
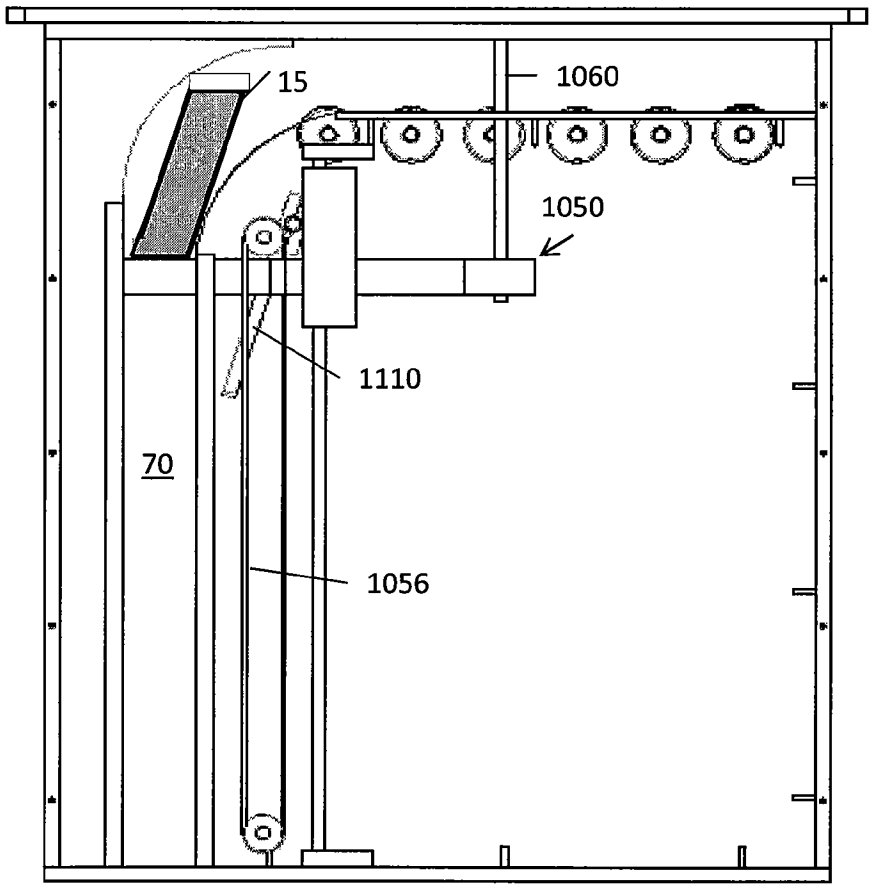
Figure 18E:
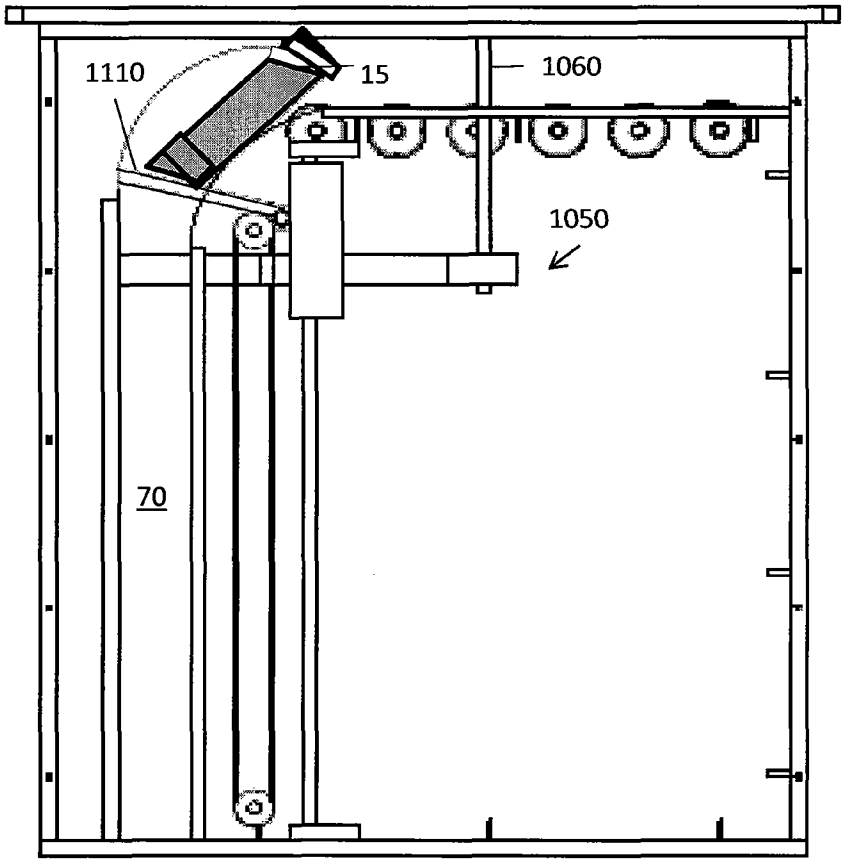

FIG. 18*c* shows the shuffler apparatus with the lift gate 1100 raised. In this third state, a card shuffling operation may be performed as has previously been described. After completion of the card shuffling operation, the cards may be counted, providing a card counting device such as that of FIG. 16 has been installed in the compartment 70.

In a fourth state, the elevator belt 1056 is actuated so as to raise the elevator 1050 so that the deck of cards is positioned near to the top of the compartment 70. In this state, the vertical rods 1060 pass through apertures in the card transport support 1030, and extend into the space above the transport support 1030 so as to prevent cards of the deck of cards 15 from moving further to the right than the position of the vertical rods 1060.

Figure 18F:
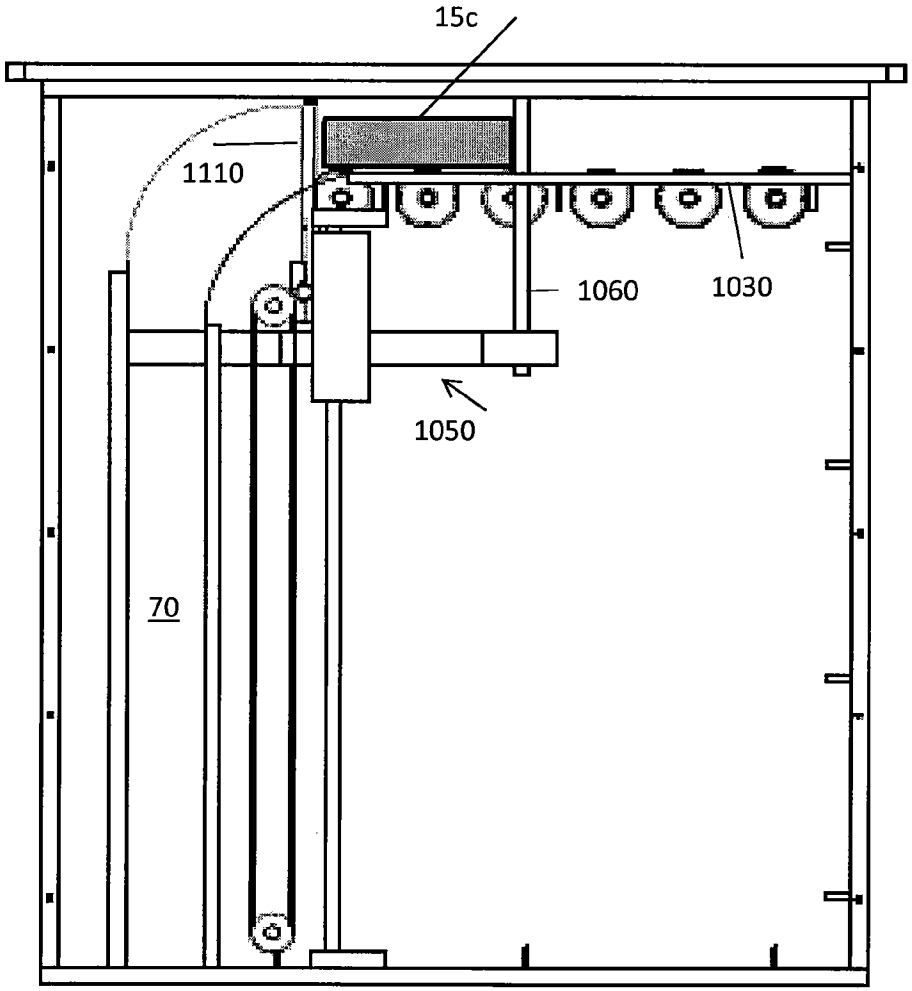

In a fifth state, the lift gate 1100 is rotated about axle 1041 so as to lift the deck of cards 15 above the top of the compartment 70 and to urge the cards onto the horizontal transport mechanism. The horizontal transport mechanism may be operated so as to assist in this process. As the lift gate 1100 is rotated into a vertical position, the cards of the deck of card 15 are moved so as to be positioned as shown in FIG. 18*f*. Further motion of the cards 15*c* to the right is prevented by the vertical rods 1060, and the cards 15 are thus positioned between the lift gate 1100 in the vertical position and the vertical rods 1060.

Figure 18G:
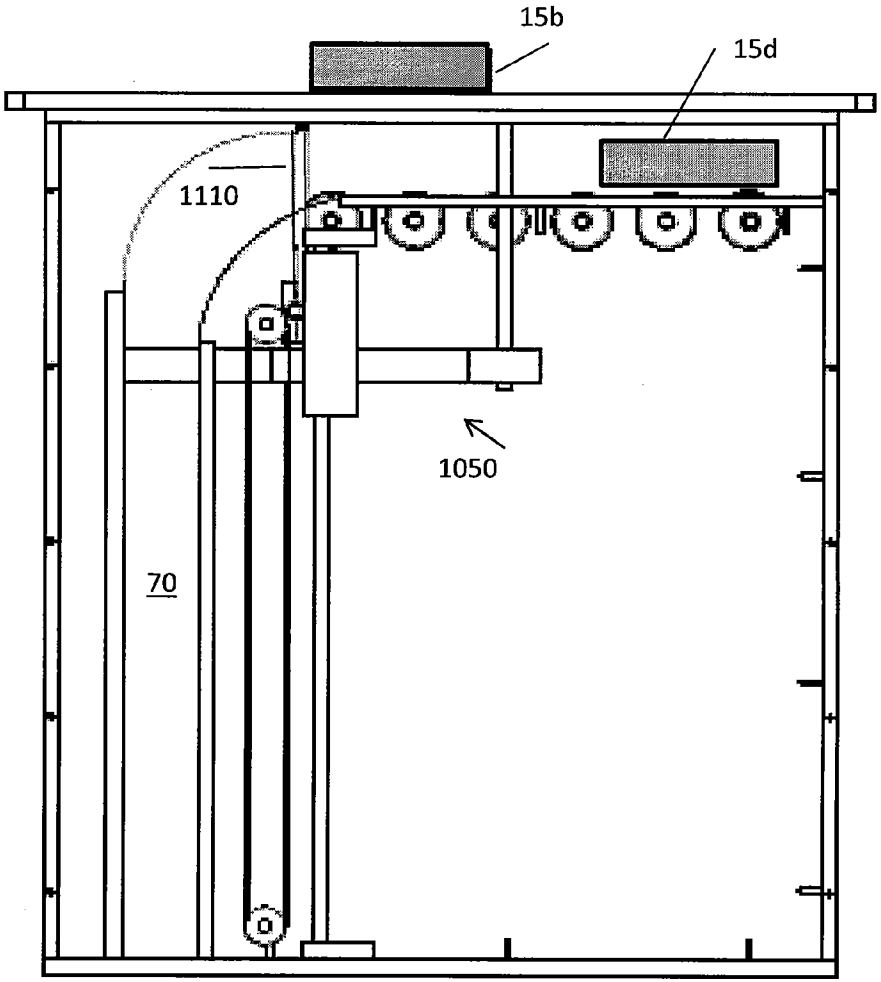

Using an elevator mechanism (not shown) the cards 15*c* may be lifted into a dispensing position by an elevator, so that the cards are in a position 15*b* as shown in FIG. 18*g*. Alternatively the use may reach into the aperture to remove the cards. The top cover 1010 is open in this state, and a "used" deck of cards may also be introduced as shown in position 15*d*. The removal of the cards from position 15*b*, and the presence of cards at position 15*d* may be sensed, and used to initiate another shuffling cycle. The top cover 1010 may be closed, and the elevator and lift gate 1100 may be moved into positions previously described.

The various states have been described for convenience only, and the sequence of operations may result in performing the operations in a continuous manner, or performing operations in other than the state described, as would be evident to a person of skill in the art. Although a few sensing operations were described, other sensing operations may be performed so as to determine the state of the apparatus and the cards and to detect any faults.

Ancillary equipment such as a power supply, which may be batteries, a AC-DC converter (battery eliminator), an AC power supply, a controller, or the like, are not shown as they are well known to persons of ordinary skill in the art, as are the various types of motors, displays, solenoids, control interfaces and the like.

Although the present invention has been explained by way of the examples described above, it should be understood to the ordinary skilled person in the art that the invention is not limited to the examples, but rather that various changes or modifications thereof are possible without departing from the spirit of the invention. Accordingly, the scope of the invention shall be determined only by the appended claims and their equivalents.

What is claimed is:

1. A card shuffling apparatus for mounting beneath a surface, comprising:

a housing having a top surface adapted to be mountable to the surface;

an aperture in the top surface dimensioned so that a deck of cards, oriented with a card face horizontally disposed, is insertable into the aperture;

a first transport mechanism adapted to move the deck of cards in a horizontal direction so as to fall into a compartment;

a card shuffling device adapted to shuffle cards in the compartment;

a second transport mechanism adapted to move the deck of cards in a vertical direction to an upper position in the compartment;

a lift-gate mechanism adapted to transfer the deck of cards from the upper position in the compartment to a position on the first transport mechanism.

2. The card shuffling apparatus of claim 1, wherein a card counting device is mounted at a position above the bottom of the compartment and below the level of the first transport mechanism.

3. The card shuffling apparatus of claim 1, further comprising a retractable stop which, when extended, locates one end of a region in which the cards of the deck of cards are located after shuffling and prior to being dispensed.

4. The card shuffling apparatus of claim 3, wherein the retractable stop is retracted or extended based on a state of the second transport mechanism.

5. The card shuffling apparatus of claim 1, the card shuffling device comprises the compartment sized and dimensioned to receive the deck of cards, each card of the deck of cards having a height dimension and a width dimension parallel to a face thereof, a thickness dimension orthogonal to the face thereof; and, edges around the periphery of the face; the received cards having a rest position with an edge of a card of the deck of cards in contact with a lower surface of the compartment; and a forcer operable so as to eject cards in a direction such that the force of gravity returns the ejected cards to the rest position.

* * * * *